US010159356B1

(12) United States Patent
Flannery et al.

(10) Patent No.: US 10,159,356 B1
(45) Date of Patent: Dec. 25, 2018

(54) INFANT LOUNGER

(71) Applicant: Regalo International, LLC, Longboat Key, FL (US)

(72) Inventors: Mark A. Flannery, Longboat Key, FL (US); Brian M. McMahon, Palatine, IL (US); Caleb Summers, Minneapolis, MN (US)

(73) Assignee: Regalo International, LLC, Longboat Key, FL (US)

( * ) Notice: Subject to any disclaimer, the term of this patent is extended or adjusted under 35 U.S.C. 154(b) by 0 days.

(21) Appl. No.: 15/595,716

(22) Filed: May 15, 2017

Related U.S. Application Data

(60) Provisional application No. 62/336,740, filed on May 15, 2016.

(51) Int. Cl.

| | |
|---|---|
| ***A47C 19/04*** | (2006.01) |
| ***A47C 4/30*** | (2006.01) |
| ***A47C 4/00*** | (2006.01) |
| ***A47D 9/00*** | (2006.01) |

(52) U.S. Cl.
CPC ..... *A47D 9/005* (2013.01); *A47C 4/00* (2013.01)

(58) Field of Classification Search
CPC .. A47C 1/14; A47C 1/143; A47C 3/12; A47C 4/022; A47C 4/28; A47C 4/286; A47C 4/30; A47C 4/42; A47C 4/44; A47C 4/48; A47D 9/005; A47D 1/00
See application file for complete search history.

(56) References Cited

U.S. PATENT DOCUMENTS

| | | | | | |
|---|---|---|---|---|---|
| 4,836,601 | A * | 6/1989 | Cone | A47C 4/286 | 297/16.2 |
| 5,718,473 | A * | 2/1998 | Lynch, Jr. | A47C 4/286 | 297/16.2 |
| 5,762,310 | A * | 6/1998 | Schill | A47D 1/004 | 248/164 |
| 5,984,406 | A * | 11/1999 | Lee | A47C 4/286 | 297/16.2 |
| 6,402,230 | B1 * | 6/2002 | Tang | A47C 1/026 | 297/16.2 |
| 6,454,348 | B1 * | 9/2002 | Wu | A47C 4/286 | 297/16.2 |
| 6,564,402 | B1 * | 5/2003 | Lin | A47C 17/645 | 24/72.5 |
| 6,629,722 | B1 * | 10/2003 | Tang | A47C 7/62 | 297/188.08 |
| 6,647,560 | B1 * | 11/2003 | Hingley | A47K 11/04 | 297/16.2 |
| 6,698,827 | B2 * | 3/2004 | Le Gette | A45F 4/02 | 297/129 |

(Continued)

*Primary Examiner* — Eric J Kurilla
*Assistant Examiner* — Rahib T Zaman

(57) ABSTRACT

A three pivot point foldable frame has first and second lower front hubs, first and second upper front hubs, a lower rear hub, and an upper rear hub. Six support members interconnect the hubs. First and second support members pivotally engage each other at a first pivot. Third and fifth support members pivotally engage each other at a second pivot. Fourth and sixth support members pivotally engage each other at a third pivot. A child seat or bedding having a receptacle formed therein is engaged to the upper hubs. The frame folds out to an operating position and in to a compact position.

20 Claims, 18 Drawing Sheets

(56) References Cited

U.S. PATENT DOCUMENTS

| | | | | |
|---|---|---|---|---|
| 6,820,927 | B2 * | 11/2004 | Isom | A47C 7/66 297/129 |
| 6,926,356 | B2 * | 8/2005 | Chen | A47C 4/286 297/35 |
| 7,328,940 | B2 * | 2/2008 | Zheng | A47C 4/286 297/16.2 |
| 7,441,287 | B2 * | 10/2008 | Zheng | A45F 3/24 5/116 |
| 7,681,267 | B1 * | 3/2010 | Hall | A47D 5/006 5/115 |
| 7,926,447 | B2 * | 4/2011 | Flannery | A01K 1/0353 119/28.5 |
| 8,801,090 | B2 * | 8/2014 | Akkad | A47C 4/48 297/46 |
| 2006/0219181 | A1 * | 10/2006 | Pape | A01K 1/0353 119/28.5 |
| 2008/0127413 | A1 * | 6/2008 | Flannery | A47C 17/72 5/111 |
| 2009/0250978 | A1 * | 10/2009 | Reynolds | A47D 1/02 297/16.2 |
| 2011/0049942 | A1 * | 3/2011 | Gorinas | A47C 4/286 297/118 |
| 2013/0113240 | A1 * | 5/2013 | Huntsberger | A47D 1/02 297/188.01 |
| 2014/0097647 | A1 * | 4/2014 | Grace | A47C 3/0255 297/42 |

* cited by examiner

INFANT LOUNGER

This application claims the benefit under 35 U.S.C. 119(e) of U.S. Provisional Patent Application No. 62/336,740 filed May 15, 2016, which provisional application is hereby incorporated by reference in its entirety into this application.

FIELD OF THE INVENTION

The present invention relates generally to an infant seat, particularly to an infant recliner, and specifically to an infant lounger.

BACKGROUND OF THE INVENTION

Folding frames having four or more pivot points may be relatively easy to design. Folding frames having three pivot points exactly may be rather difficult to design but may result in functional structures that have the added benefit of being aesthetically pleasing to many eyes.

SUMMARY OF THE INVENTION

A feature of the present invention is a three pivot point foldable frame.

Another feature of the present invention is the provision in a three pivot point foldable frame, of a soft structure such that the frame and soft structure makes up an infant recliner or infant lounger.

Another feature of the present invention is the provision in a three pivot point foldable frame, of first and second lower front hubs, first and second upper front hubs, a lower rear hub, and an upper rear hub.

Another feature of the present invention is the provision in a three pivot point foldable frame, of first and second lower front hubs, first and second upper front hubs, a lower rear hub, an upper rear hub and no more hubs.

Another feature of the present invention is the provision in a three pivot point foldable frame, of a first support member extending between the first lower front hub and the second upper front hub, a second support member extending between the second lower front hub and first upper front hub, a third support member extending between the first lower front hub and the upper rear hub, a fourth support member extending between the second lower front hub and the upper rear hub, a fifth support member extending between the first upper front hub and the lower rear hub, and a sixth support member extending between the second upper front hub and the lower rear hub.

Another feature of the present invention is the provision in a three pivot point foldable frame, of a first support member extending between the first lower front hub and the second upper front hub, a second support member extending between the second lower front hub and first upper front hub, a third support member extending between the first lower front hub and the upper rear hub, a fourth support member extending between the second lower front hub and the upper rear hub, a fifth support member extending between the first upper front hub and the lower rear hub, a sixth support member extending between the second upper front hub and the lower rear hub and no more support members.

Another feature of the present invention is the provision in a three pivot point foldable frame, of the first and second support members pivotally engaged to each other at a first pivot, the third and fifth support members pivotally engaged to each other at a second pivot, and the fourth and sixth support members pivotally engaged to each other at a third pivot.

Another feature of the present invention is the provision in a three pivot point foldable frame, of the first and second support members pivotally engaged to each other at a first pivot, the third and fifth support members pivotally engaged to each other at a second pivot, the fourth and sixth support members pivotally engaged to each other at a third pivot, and no more pivots between support members.

Another feature of the present invention is the provision in a three pivot point foldable frame, of the three pivot point foldable frame including a folded out and operating position and a folded in and compact position, where, in the folded in and compact position, the first and second lower front hubs are adjacent to each other, the first and second upper front hubs are adjacent to each other, and the lower rear hub is adjacent to the first and second lower front hubs.

Another feature of the present invention is the provision in a three pivot point foldable frame, of the three pivot point foldable frame including a folded out and operating position and a folded in and compact position, where, in the folded out and operating position, the first lower front hub is closer to the first upper front hub than the second lower front hub, and the second lower front hub is closer to the second upper front hub than the first lower front hub.

Another feature of the present invention is the provision in a three pivot point foldable frame, of each of the first, second, third, fourth, fifth, and sixth support members generally forming the shape of an "S."

Another feature of the present invention is the provision in a three pivot point foldable frame, of in the folded out and operating position, the first and second support members, in combination, forming generally the shape of an upper case "H."

Another feature of the present invention is the provision in a three pivot point foldable frame, of, in the folded out and operating position, the third and fifth support members, in combination, forming generally the shape of a lower case "h."

Another feature of the present invention is the provision in a three pivot point foldable frame, of, in the folded out and operating position, the fourth and sixth support members, in combination, forming generally the shape of a lower case "h."

Another feature of the present invention is the provision in a three pivot point foldable frame, of each of the first, second, third, fourth, fifth, and sixth support members including a middle section, a lower section and an upper section, where each of the middle, lower and upper sections are straight, where the lower section is disposed obliquely relative to the middle section, and where the upper section is disposed obliquely relative to the middle section.

Another feature of the present invention is the provision in a three pivot point foldable frame, of each of the first, second, third, fourth, fifth, and sixth support members including first and second transition sections, where each of the first and second transition sections are curved, where the first transition section is disposed between the lower section and the middle section, and where the second transition section is disposed between the upper section and the middle section.

Another feature of the present invention is the provision in a three pivot point foldable frame, of the upper section of the third support member having a greater length than the lower section of the third support member, and of the upper section of the fourth support member having a greater length than the lower section of the fourth support member.

Another feature of the present invention is the provision in a three pivot point foldable frame, of the lower section of the fifth support member having a greater length than the upper section of the fifth support member, and of the lower section of the sixth support member having a greater length than the upper section of the sixth support member.

Another feature of the present invention is the provision in a three pivot point foldable frame, of the upper sections of the third and fourth support members converging toward each other as the upper sections of the third and fourth support members extend toward the upper rear hub.

Another feature of the present invention is the provision in a three pivot point foldable frame, of the lower sections of the fifth and sixth support members converging toward each other as the lower sections of the fifth and sixth support members extend toward the lower rear hub.

Another feature of the present invention is the provision in a three pivot point foldable frame, of the lower sections of the third and fourth support members diverging away from each other as said lower sections extend toward the first and second lower front hubs, respectively.

Another feature of the present invention is the provision in a three pivot point foldable frame, of the upper sections of the fifth and sixth support members diverging away from each other as said upper sections extend toward the first and second upper front hubs, respectively.

Another feature of the present invention is the provision in a three pivot point foldable frame, of the third and fourth support members including upper ends spaced apart from each other by a first distance, where the fifth and sixth support members include lower ends spaced apart from each other by a second distance, and where the second distance is greater than the first distance.

Another feature of the present invention is the provision in a three pivot point foldable frame, of, in the folded in and compact position, the lower rear hub being disposed at a base elevation, the first and second lower front hubs being disposed at a second elevation greater than the base elevation, the first and second upper front hubs being disposed at a third elevation greater than the second elevation, and the rear hub being disposed at a fourth elevation greater than the third elevation.

Another feature of the present invention is the provision in a three pivot point foldable frame, of a pivotal engagement at the first lower front hub between the first lower front hub and the first support member defining a first pivot axis, of a pivotal engagement at the first lower front hub between the first lower front hub and the third support member defining a second pivot axis, where the first and second pivot axis define an oblique angle.

Another feature of the present invention is the provision in a three pivot point foldable frame, of a seat, the seat being engaged to the first and second upper hubs and the upper rear hub, the seat including a flexible material, and the seat including a receptacle shaped portion.

Another feature of the present invention is the provision in a three pivot point foldable frame, of flexible material engaged to and between the first and second upper hubs, where, in the folded out and operating position, the flexible material is taut such that the first and second support members are prevented from pivoting relative to each other in one direction and such that, when the first and second support members pivot relative to each other in the other direction, the flexible material folds.

An advantage of the present invention is a frame having a minimum of scissoring support members.

Another advantage of the present invention is a frame having a minimum of pivot points located intermediate of opposite ends of support members.

Another advantage of the present invention is a frame having a minimum of pivot points that is foldable.

Another advantage of the present invention is a frame having a minimum of pivot points that is aesthetically pleasing to many eyes.

DETAILED DESCRIPTION

Figure 10:
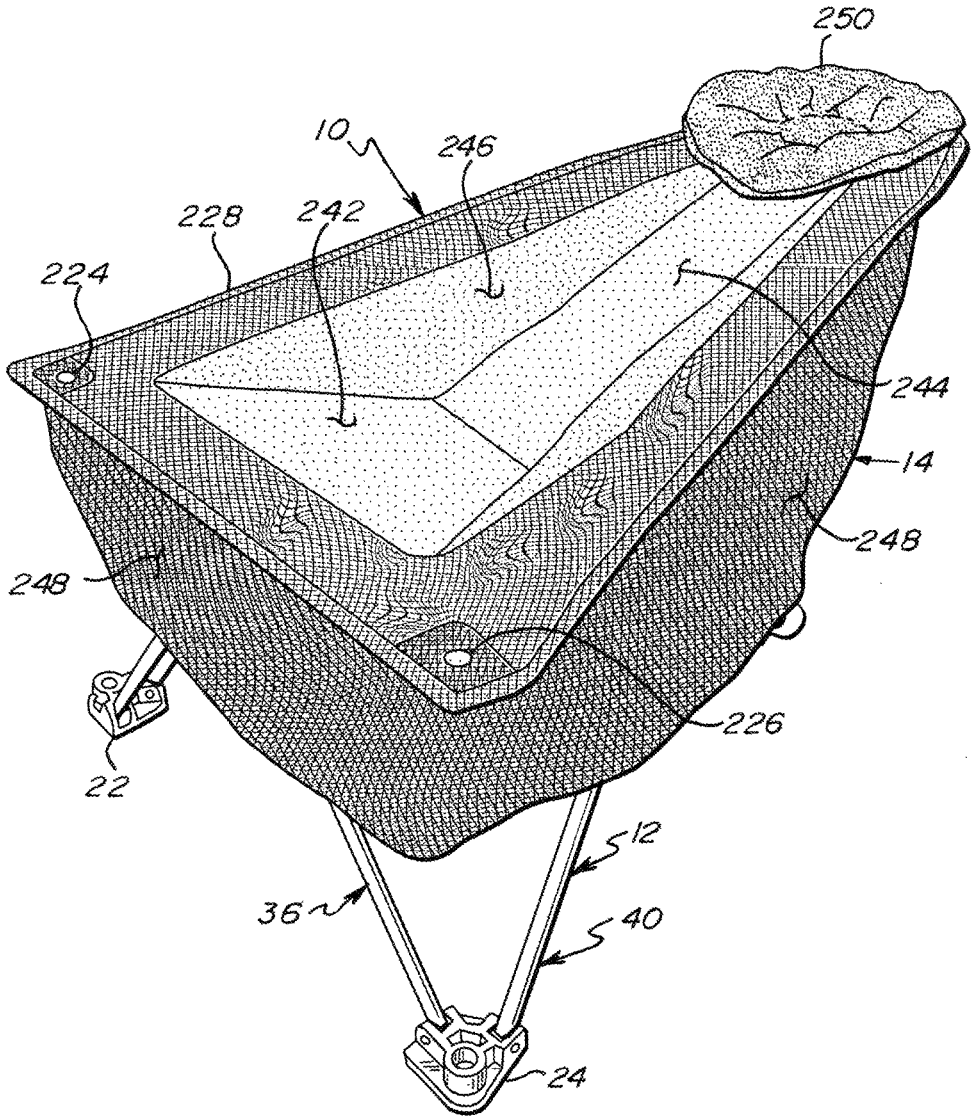
FIG. 10 is a perspective view of the frame and first flexible sheeting combination of FIG. 9 having second flexible sheeting engaged thereon and further having a headrest.

As shown in FIG. 10, the present infant lounger is indicated by reference number 10. The infant lounger 10 includes a frame 12 and a set of flexible components 14.

Figure 1:
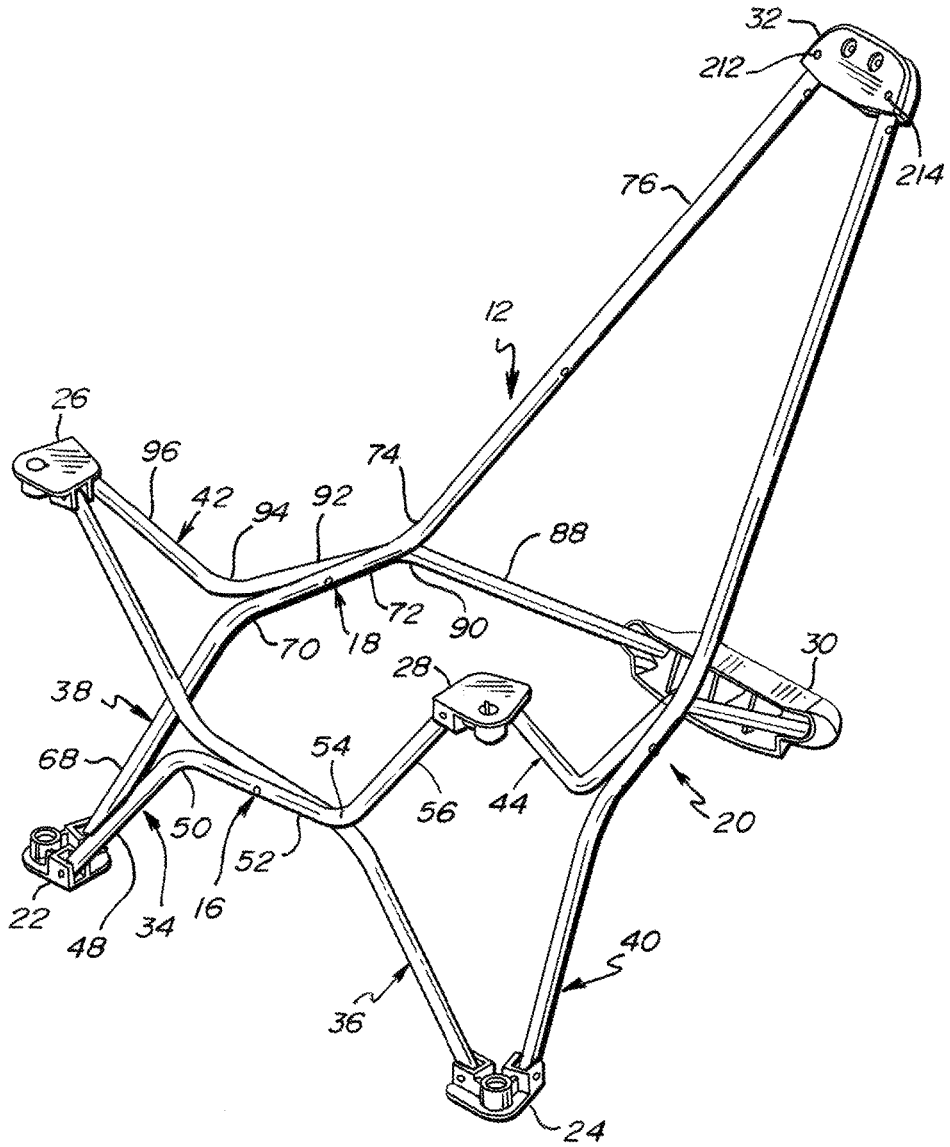
FIG. 1 is a perspective detail view of the frame of the present infant lounger.

A perspective view of frame 12 is shown in FIG. 1. Frame 12 is a three pivot point foldable frame. Frame 12 is generally in the form of a seat. Frame 12 includes a first pivot point or pivot 16, a second pivot point or pivot 18 and a third pivot point or pivot 20.

Frame 12 includes first and second lower front hubs 22, 24, first and second upper front hubs 26, 28, lower rear hub 30, an upper rear hub 32.

Frame 12 includes a first support member 34 extending between the first lower front hub 22 and the second upper front hub 28, a second support member 36 extending between the second lower front hub 24 and first upper front hub 26, a third support member 38 extending between the first lower front hub 22 and the upper rear hub 32, a fourth support member 40 extending between the second lower front hub 24 and the upper rear hub 32, a fifth support member 42 extending between the first upper front hub 26 and the lower rear hub 30, a sixth support member 44 extending between the second upper front hub 28 and the lower rear hub 30.

The first and second support members 34, 36 are pivotally engaged to each other at the first pivot 16. The third and fifth support members 38, 42 are pivotally engaged to each other at the second pivot 18. The fourth and sixth support members 40, 44 are pivotally engaged to each other at the third pivot 20.

Figure 8A:
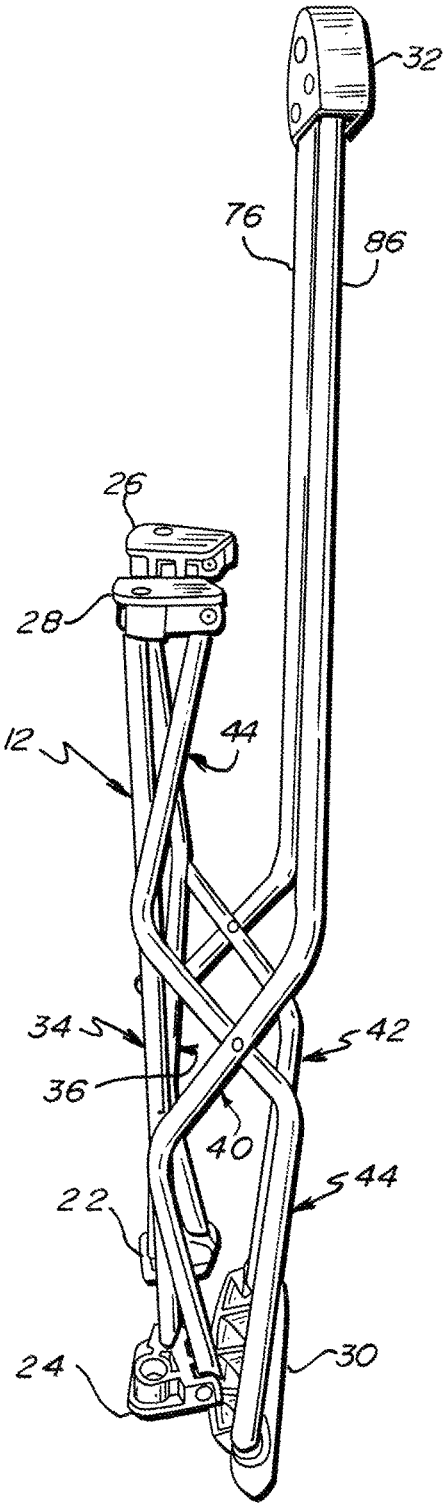
FIG. 8A is a side detail view of the frame of the infant lounger of FIG. 1 in a collapsed form.
Figure 8B:
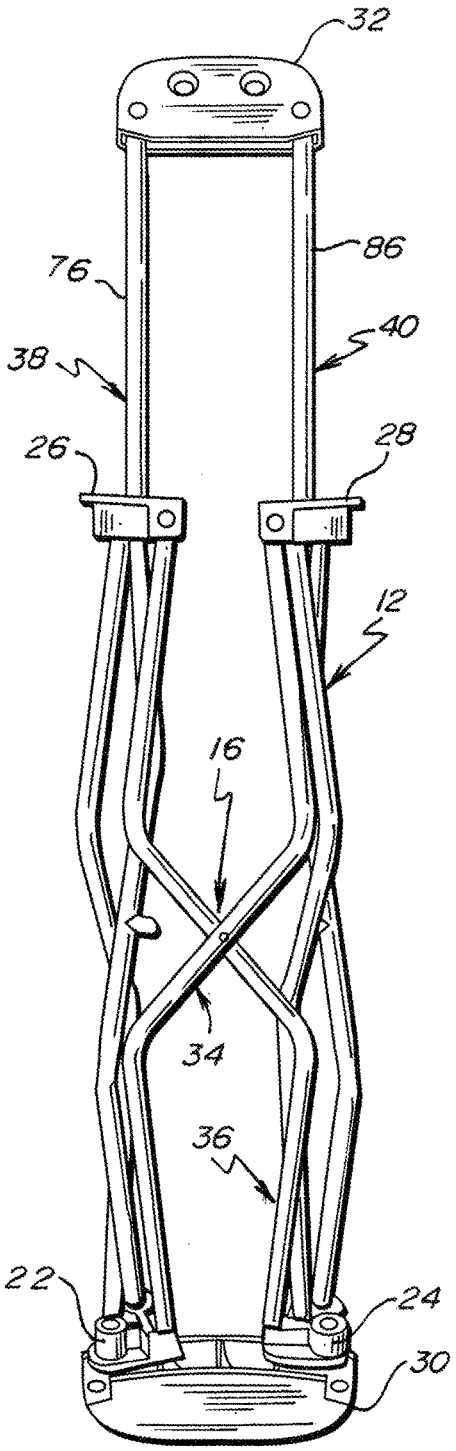
FIG. 8B is a front detail view of the frame of the infant lounger of FIG. 1 in a collapsed form.

As shown in FIGS. 1, 2A, 3A, 4A, 9 and 10, the three pivot point foldable frame 12 includes a folded out and operating position. As shown in FIGS. 8A and 8B, the three pivot point foldable frame 12 includes a folded in and compact position. In the folded in and compact position of FIGS. 8A and 8B, the first and second lower front hubs 22, 24 are adjacent to each other, the first and second upper front hubs 26, 28 are adjacent to each other, and the lower rear hub 30 is adjacent to the first and second lower front hubs 22, 24.

Figure 2B:
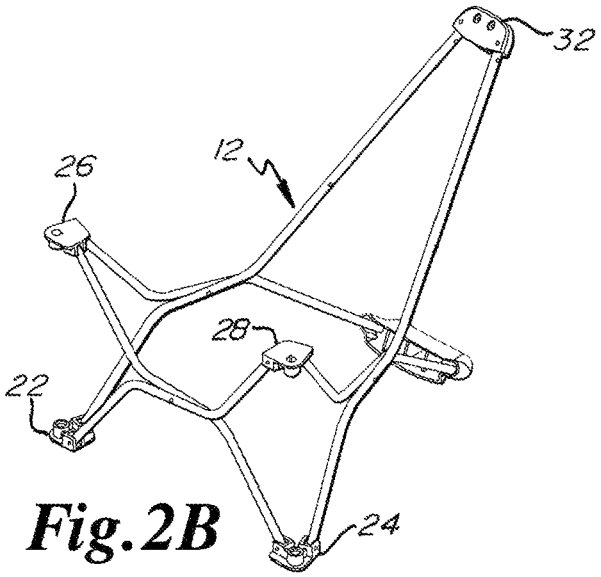
FIG. 2B is a small view of the infant lounger of FIG. 1 for reference when considering FIG. 2A.
Figure 2A:
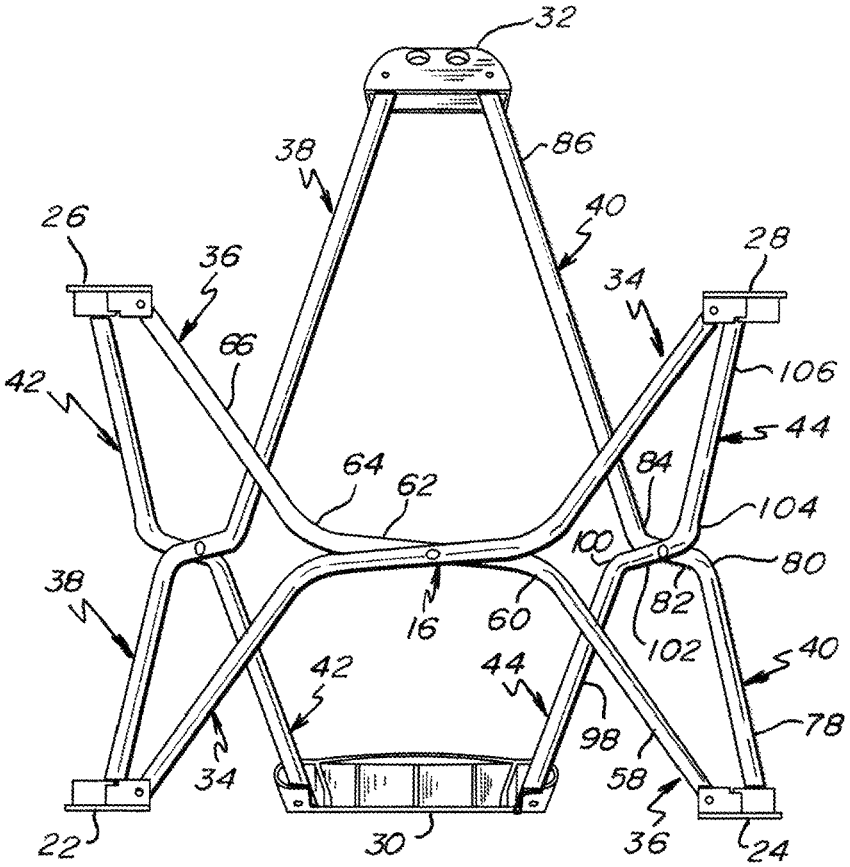
FIG. 2A is a front detail view of the frame of the infant lounger of FIG. 1.

In the folded out and operating position, such as shown in FIG. 2A, the first lower front hub 22 is closer to the first upper front hub 26 than the second lower front hub 24, and the second lower front hub 24 is closer to the second upper front hub 28 than the first lower front hub 22.

As shown in FIG. 1, in the folded out and operating position, each of the first, second, third, fourth, fifth, and sixth support members 34, 36, 38, 40, 42, and 44 generally forms the shape of an "S."

As shown in FIG. 1, in the folded out and operating position, the first and second support members 34, 36, in combination, form generally the shape of an upper case "H."

Figure 4B:
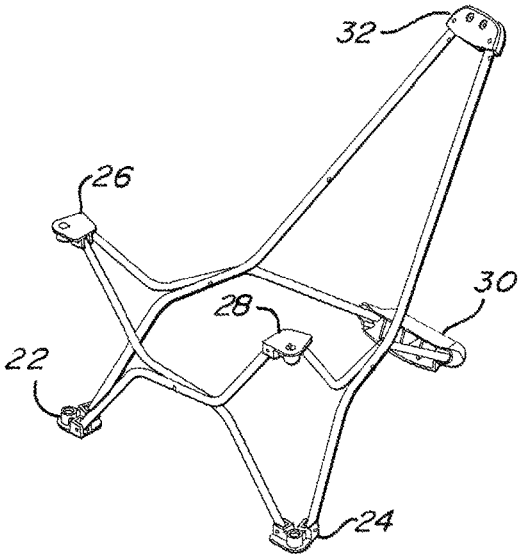
FIG. 4B is a small view of the infant lounger of FIG. 1 for reference when considering FIG. 4A.
Figure 4A:
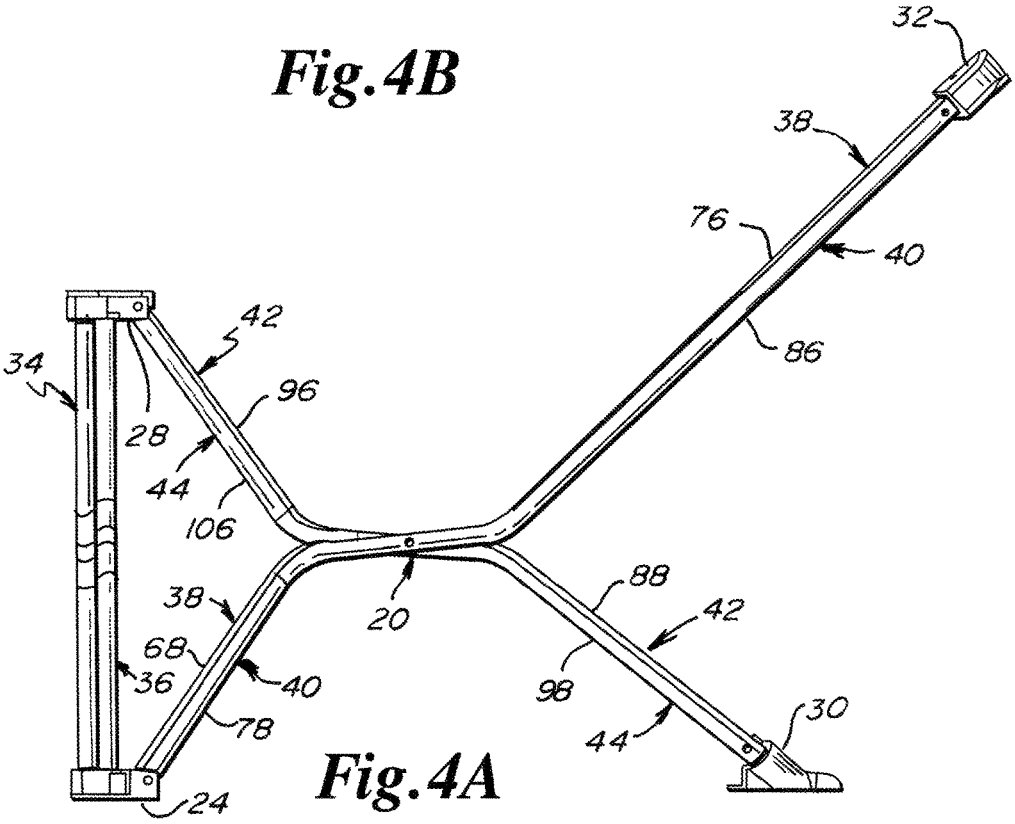
FIG. 4A is a side detail view of the frame of the infant lounger of FIG. 1.

As shown in FIG. 4A, in the folded out and operating position, the third and fifth support members 38, 42, in combination, form generally the shape of a lower case "h."

As shown in FIG. 4A, in the folded out and operating position, the fourth and sixth support members 40, 44, in combination, form generally the shape of a lower case "h."

Each of the first, second, third, fourth, fifth, and sixth support members 34, 36, 38, 40, 42, and 44 includes a middle section, a lower section and an upper section. Each of such middle, lower and upper sections is straight. Each of such lower sections is disposed obliquely relative to its respective middle section. Each of such upper sections is disposed obliquely relative to its respective middle section.

Each of the first, second, third, fourth, fifth, and sixth support members 34, 36, 38, 40, 42, and 44 includes first and second transition sections. Each of the first and second transition sections is curved. The first transition section is disposed between its respective lower section and middle section. The second transition section is disposed between its respective upper section and middle section.

As shown in FIG. 4A, the upper section of the third support member 38 has a greater length than the lower section of the third support member 38, and the upper section of the fourth support member 40 has a greater length than the lower section of the fourth support member 40.

As shown in FIG. 4A, the lower section of the fifth support member 42 has a greater length than the upper section of the fifth support member 42, and the lower section of the sixth support member 44 has a greater length than the upper section of the sixth support member 44.

As shown in FIG. 2A, the upper sections of the third and fourth support members 38, 40 converge toward each other as the upper sections of the third and fourth support members 38, 40 extend toward the upper rear hub 32.

As shown in FIG. 2A, the lower sections of the fifth and sixth support members 42, 44 converge toward each other as the lower sections of the fifth and sixth support members 42, 44 extend toward the lower rear hub 30.

As shown in FIG. 2A, the lower sections of the third and fourth support members 38, 40 diverge away from each other as such lower sections of the third and fourth support members 38, 40 extend toward the first and second lower front hubs 22, 24, respectively.

As shown in FIG. 2A, the upper sections of the fifth and sixth support members 42, 44 diverge away from each other as such upper sections of the fifth and sixth support member 42, 44 extend toward the first and second upper front hubs 26, 28, respectively.

As shown in FIG. 2A, the third and fourth support members 38, 40 include upper ends spaced apart from each other by a first distance and engaging hub 32, and the fifth and sixth support members 38, 40 include lower ends spaced apart from each other by a second distance and engaging lower front hubs 22, 24, respectively, with such second distance being greater than such first distance.

As shown in FIGS. 8A and 8B, in the folded in and compact position, the lower rear hub 30 is disposed at a base elevation, the first and second lower front hubs 22, 24 are disposed at a second elevation greater than the base elevation, the first and second upper front hubs 26, 28 are disposed at a third elevation greater than the second elevation, and the upper rear hub 32 is disposed at a fourth elevation greater than the third elevation.

As shown in FIGS. 1, 5A, 5B and 5C, a pivotal engagement at the first lower front hub 22 between the first lower front hub 22 and the first support member 34 defines a first pivot axis, wherein a pivotal engagement at the first lower front hub 22 between the first lower front hub 22 and the third support member 38 defines a second pivot axis, and wherein such first and second pivot axis define an oblique angle.

Figure 9:
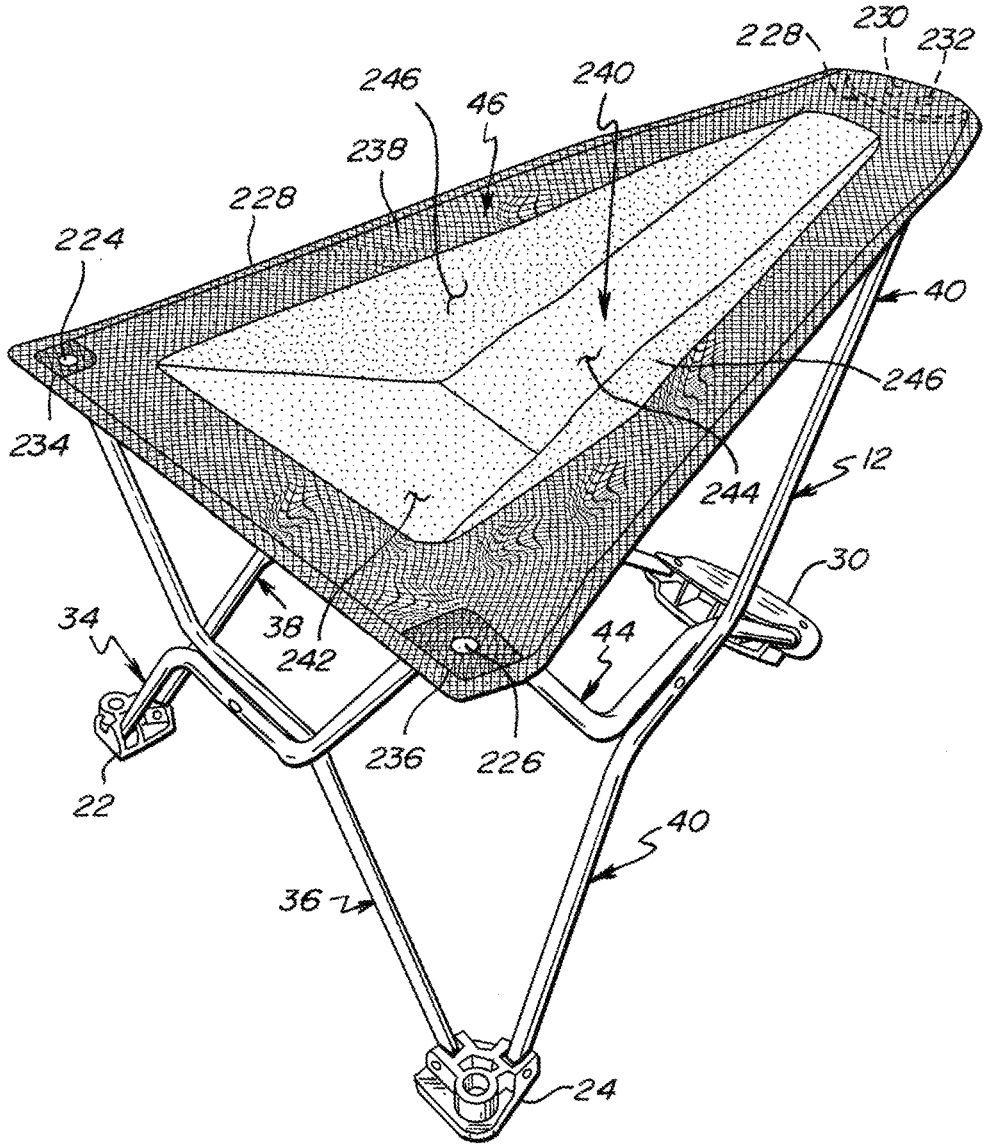
FIG. 9 is a perspective view of first flexible sheeting permanently or removably mounted on the infant lounger frame of FIG. 1 to prevent the frame from folding in one way and to permit the frame to fold the other way.

As shown in FIG. 9, the lounger 10 includes a seat 46. The seat 46 is engaged to the first and second upper hubs 26, 28 and the upper rear hub 32. The seat 46 is formed of a flexible sheeting material. The seat 46 is formed in a shape of a receptacle. The seat 46 includes material engaged to and between the first and second upper hubs 26, 28, where, in the folded out and operating position such as shown in FIG. 9, the flexible material is taut such that the first and second support members 34, 36 are prevented from pivoting relative to each other in one direction and such that, when the first and second support members 34, 36 pivot relative to each other in the other direction, the flexible material folds.

FIGS. 1 and 2A show relatively clearly almost all of the support members 34, 36, 38, 40, 42, 44. Each of the support members 34, 36, 38, 40, 42, 44 is integral and one-piece. Each of the support members is tubular and formed of a metal such as steel or aluminum.

Support member 34 includes, from bottom to top, lower section 48, transition section 50, middle section 52, transition section 54, and upper section 56.

Support member 36 includes, from bottom to top, lower section 58, transition section 60, middle section 62, transition section 64, and upper section 66.

Support member 38 includes, from bottom to top, lower section 68, transition section 70, middle section 72, transition section 74, and upper section 76.

Support member 40 includes, from bottom to top, lower section 78, transition section 80, middle section 82, transition section 84, and upper section 86.

Support member 42 includes, from bottom to top, lower section 88, transition section 90, middle section 92, transition section 94, and upper section 96.

Support member 44 includes, from bottom to top, lower section 98, transition section 100, middle section 102, transition section 104, and upper section 106.

As seen in each of FIGS. 1 and 2A, support members 34, 36, 38, 40, 42, and 44 and hubs 22, 24, 26, 28, 30 and 32 provide an endless train. In other words, the endless train runs from first lower front hub 22 to support member 34 to second upper front hub 28 to support member 44 to lower rear hub 30 to support member 42 to first upper front hub 26 to support member 36 to second lower front hub 24 to support member 40 to upper rear hub 32 to support member 38 and back to first lower front hub 22.

Support member 40, extending from second lower front hub 24 to upper rear hub 32, lies outside of support member 44. Support member 38, extending from first lower front hub 22 to upper rear hub 32, lies inside of support member 42.

Support member 34, extending from first lower front hub 32 to second upper front hub 28, lies outside of support member 36 that extends from second lower front hub 24 to first upper front hub 26.

Support members 34 and 36 are front support members and extend between the front hubs 22, 24, 26, 28.

Support members 40 and 44 are left side support members and are disposed on the left side of the lounger 10, relative to the infant laying on his or her back in the seat 46 of the lounger 10. Hubs 24 and 28 are, likewise, left side hubs.

Support members 38 and 42 are right side support members and are disposed on the right side of the lounger 10, relative to an infant laying on his or her back in the seat 46 of the lounger 10. Hubs 22, 26 are, likewise, right side hubs.

Figure 3B:
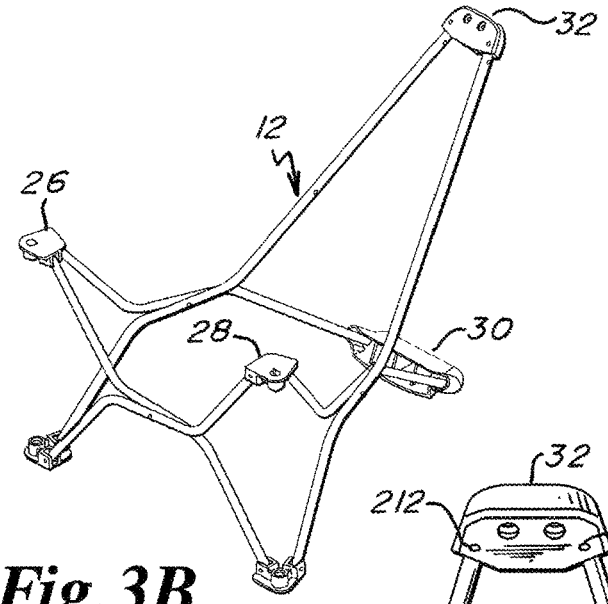
FIG. 3B is a small view of the infant lounger of FIG. 1 for reference when considering FIG. 3A.
Figure 3A:
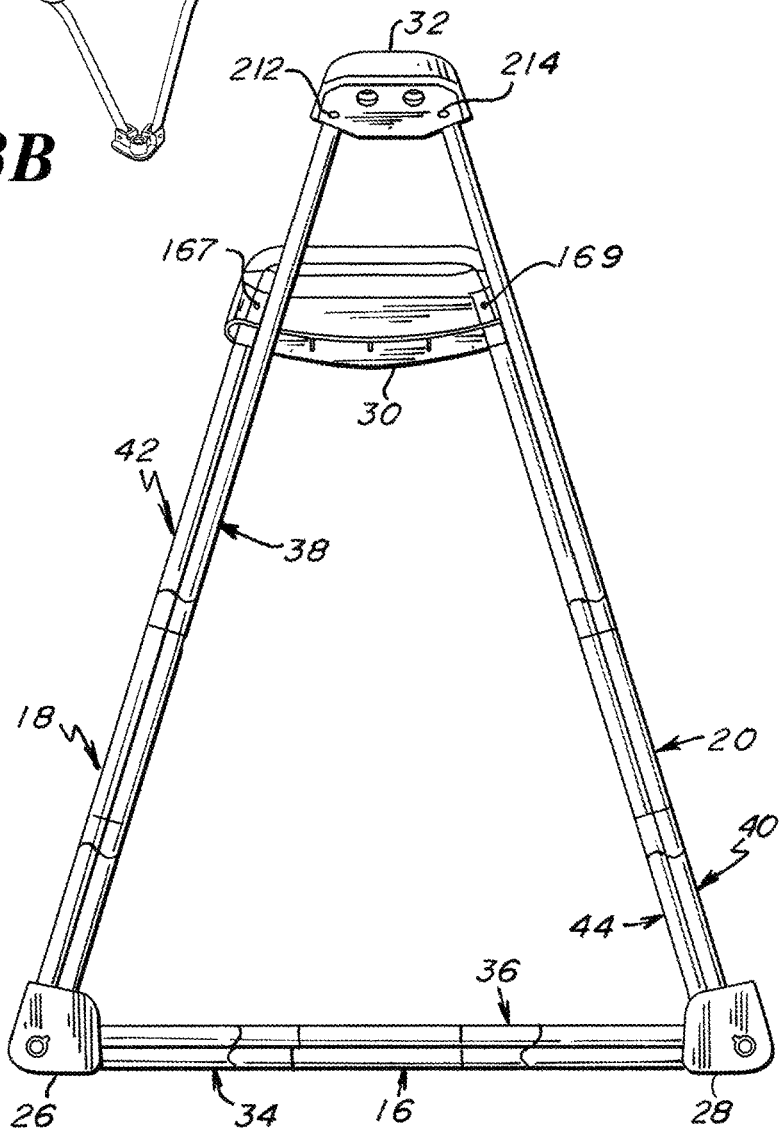
FIG. 3A detail top view of the frame of the infant lounger of FIG. 1.

FIGS. 2A and 3A show, in combination, that the right side lower and upper front hubs 22 and 26 are disposed, in the open and operating configuration, directly vertical of the other.

FIGS. 2A and 3A show, in combination, that the left side lower and upper front hubs 24 and 28 are disposed, in the open and operating configuration, directly vertical of the other.

FIG. 2A shows that the front lower hubs 22 and 24 and the lower rear hub 30 have undersides or floors that define a plane when the frame 12 is in the open and operating configuration.

As shown in FIG. 3A, a center of rear lower hub 30 and a center of upper rear hub 32 are laterally offset from each other relative to a longitudinal vertical plane. In other words, a longitudinal vertical plane passing through the center of upper rear hub 32 does not include the center of lower rear hub 30. Likewise, a longitudinal vertical plane passing through the center of lower rear hub 30 does not include the center of upper rear hub 32.

FIG. 3A shows that each of the support members 34, 36, 38, 40, 42, 44 lies in and defines its own plane. That is, each of the lower, middle, upper and transition sections of each of the support members 34, 36, 38, 40, 42, and 44 lies in and defines its own plane.

FIG. 3A shows that, from a top plan view, frame 12 is generally a three sided structure, where one or more support members 34, 36 make up a first side, where one or more support members 38 and 42 make up a second side, and where one or more support members 40, 44 make up a third side.

FIG. 4A shows that the lower rear hub 30 is longitudinally offset from the upper rear hub 32 relative to a lateral vertical plane. In other words, a lateral vertical plane passing through a central portion of the lower rear hub 30 does not include a central portion of the upper rear hub 32. Likewise, a lateral vertical plane passing through a central portion of upper rear hub 32 does not include a central portion of lower rear hub 30.

FIG. 4A shows that upper rear hub 32 is disposed rearwardly of lower rear hub 30.

FIG. 4A shows that upper sections 76, 86 are disposed at an angle closer to the horizontal than are upper sections 96, 106, where pivot 20 lies in a first horizontal plane and such angle is defined relative to the first horizontal plane.

FIG. 4A shows that lower sections 88, 98 are disposed at an angle closer to the horizontal than are lower sections 68, 78, where pivot 20 lies in a first horizontal plane and such angle is defined relative to the first horizontal plane.

FIGS. 5A, 5B, 5C, 5D, and 5E are representative of any of the front hubs 22, 24, 26, and 28. For clarity, the hub shown in each of FIGS. 5A, 5B, 5C, 5D and 5E is designated to be the second lower front hub 24.

Hub 24 includes a base 108. Base 108 defines a plane. Base 108 includes a flat face 110. The flat face 110 may confront the floor in the case of hubs 22, 24 or the flat face 110 may confront the seat 46 in the case of hubs 26, 28. On the other side of the base 108 from the flat face 110, a number of walls project from the base 108 and are integral with the base 108. One of these walls is an annular wall or annulus or ring like wall or cylinder 112. Cylinder 112 is coaxial with an opening 114 in the base 108. Opening 114 opens out through flat face 110. Opening 114 may be a keyed opening and/or include threads so as to receive a key or pin or connector to engage seat 46 and hold seat 46 permanently or removably to the frame 12. Cylinder 112 is disposed at a right angle relative to base 108.

Base 108 includes a pair of opposing walls 116, 118 that receive therebetween an end of a support member such as the lower end of support member 36. Wall 116 includes through opening 120 and wall 118 includes through opening 122. Openings 120, 122 are aligned with each other and receive a horizontally oriented pin that also engages the lower end of support member 36. Each of walls 116, 118 defines a plane. Wall 124 is intermediate walls 116, 118 and defines a plane.

Base 108 includes a pair of opposing walls 126, 128 that receive therebetween an end of a support member such as the lower end of support member 40. Wall 126 includes through opening 130 and wall 128 includes through opening 132. Openings 130, 132 are aligned with each other and receive a horizontally oriented pin that also engages the lower end of support member 40. Each of walls 126, 128 defines a plane. Wall 134 is intermediate walls 126, 128, extends beyond wall 126 to wall 118 and 124, and defines a plane.

Openings 120, 122 define a first horizontal axis or first horizontal straight line. Openings 126, 132 define a second horizontal axis or second horizontal straight line. The horizontal axes or straight lines intersect each other at an oblique angle. An oblique angle is defined as any angle that is not a right angle or a multiple of a right angle. The section of the first support member that is horizontally pivotally engaged at the first axis and the section of the second support member that is horizontally pivotally engaged at the second axis are disposed at an acute angle relative to each other. This acute angle can be seen from the top view of FIG. 5C.

Wall 116 extends into, and is integral with, cylinder 112. A wall 136 extends into, and is integral with, cylinder 112 and further extends into, and is integral with, wall 134. Wall 118 and walls 134 extend into each other and are integral with each other. Wall 134 extends to and between walls 124 and 132.

Cylinder 112 and walls 116, 124, 118, 136 define an open heart shaped space 138.

Figure 5F:
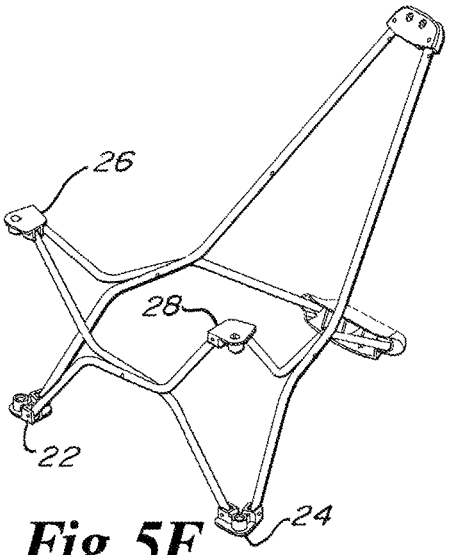
FIG. 5F is a small view of the infant lounger of FIG. 1 for reference when considering FIGS. 5A, 5B, 5C, 5D, and 5E.
Figure 5A:
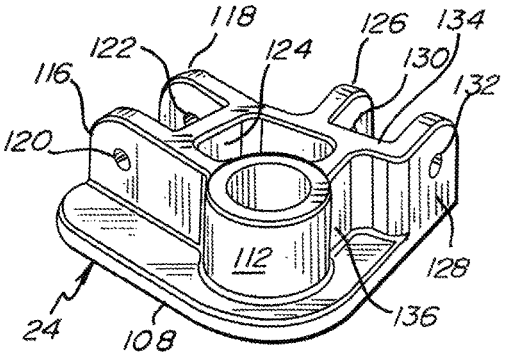
FIG. 5A is a first perspective detail view of a first hub or connection for the frame of the infant lounger of FIG. 1.
Figure 5D:
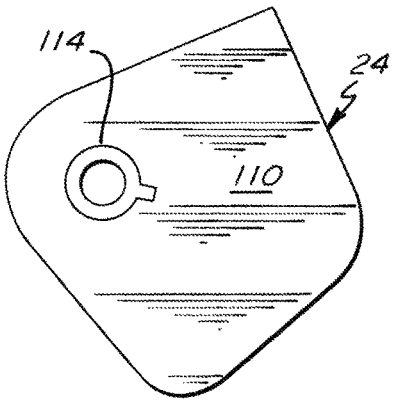
FIG. 5D is a bottom detail view of the first hub or connection of FIG. 5A.
Figure 5B:
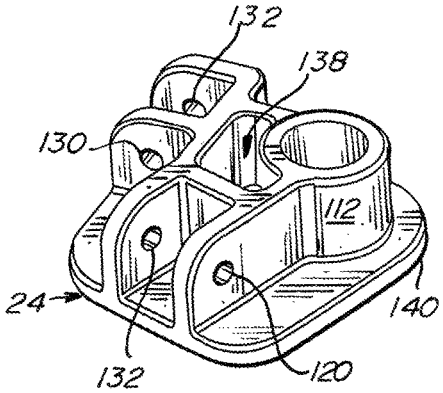
FIG. 5B is a second perspective detail view of the first hub or connection of FIG. 5A.
Figure 5E:
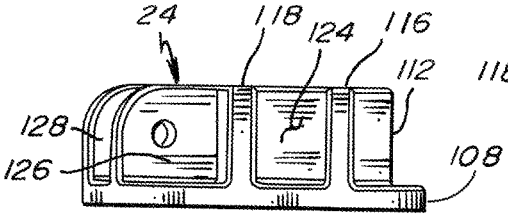
FIG. 5E is a side detail view of the first hub or connection of FIG. 5A.
Figure 5C:
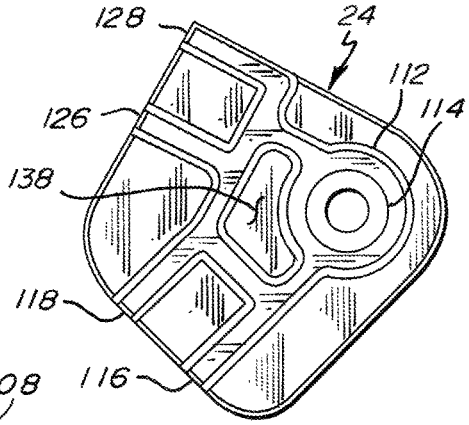
FIG. 5C is a top detail view of the first hub or connection of FIG. 5A.

The ends of walls 112, 116, 118, 124, 126, 128, 134 are opposite base 108 and define a plane, as shown in FIG. 5E. Cylinder 112 is spaced from a peripheral edge 140. Walls 116, 118, 126 and 128 extend to the peripheral edge 140. Walls 116, 118, 126, and 134 run inwardly. Wall 128 travels along the peripheral edge 140. Peripheral edge 140 includes three rounded corners and one sharp corner. Peripheral edge 140 includes four sides that are straight except for the portions of the sides that make up the three rounded corners.

FIGS. 6A, 6B, 6C and 6D show the lower rear hub 30. Hub 30 includes a base 142 for confronting and making contact with a floor upon which the lounger 10 rests. Base 142 extends from a front end to a rear end of the hub 30. Opposite of the base 142 is a ceiling 144. Ceiling 144 slopes from a front end of the hub 30 to a rear end of the hub 30. Cylindrical portion 146 joins the base 142 and ceiling 144 on one side of the hub 30. Cylindrical portion 148 joins the base 142 and ceiling 144 on the other side of the hub 30. Each of the cylindrical portions 146, 148 is a half-cylinder. Immediately inwardly of cylindrical portion 146 are upper and lower integral plate sections 150, 152. Immediately inwardly of cylindrical portion 148 are upper and lower integral plate sections 154, 156. Plate sections 150, 152 have respective openings 158, 160. Plate sections 154, 156 have respective openings 162, 164.

Cylindrical portion 146 and plate portions 150, 152 form a receptacle 166 that receives section 88 of right side support member 42. Through openings 158, 160 receive a pivot pin 167 that further engages section 88 to provide for pivoting of section 88 relative to hub 30.

Cylindrical portion 148 and plate portions 154, 156 form a receptacle 168 that receives section 98 of left side support member 44. Through openings 162, 164 receive a pivot pin 169 that further engages section 98 to provide for pivoting of section 98 relative to hub 30.

A set of brace plates 170 are set vertically between the base 142 and ceiling 144. Brace plates 170 are integral and one-piece with the base 142 and ceiling 144. Hub 30 is integral and one-piece and is a molded structure.

Base 142 defines a plane. Each of the planar base plates 150, 152, 154, 156 is set obliquely, or at an oblique angle, relative to base 142. An oblique angle is any angle but a right angle or a multiple of a right angle.

The first pivot pin 167 engaging openings 158, 160 is oblique in two ways. First, such first pivot pin 167 is oblique to a vertical plane that is at a right angle to base 142. This obliqueness can be seen in FIG. 6D where upper opening 158 is set inwardly relative to lower opening 160. Second, such first pivot pin 167 is oblique to a horizontal plane that lies parallel to base 142. This obliqueness can be seen in FIGS. 6B, 6C and 6D that show plate portions 150, 152 disposed at an angle relative to base 142.

The second pivot pin 169 engaging openings 162, 164 is oblique in two ways. First, such second pivot pin 169 is oblique to a vertical plane that is at a right angle to base 142. This obliqueness can be seen in FIG. 6D where upper opening 162 is set inwardly relative to lower opening 164. Second, such second pivot pin 169 is oblique to a horizontal plane that lies parallel to base 142. This obliqueness can be seen in FIGS. 6B, 6C and 6D that show plate portions 154, 156 disposed at an angle relative to base 142.

Pivot pins 167, 169 do not extend parallel to each other. Pivot pins 167, 169 extend obliquely relative to each other.

Ceiling 144 includes an overhang 172 extending away from the brace plates 170. Brace plates 170 are set back from a front peripheral edge 174 of base 142.

Section 88 of support member 42 includes an axis. This axis intersects base 142 intermediate of a front end and rear end of base 142. This axis intersects base 142 at a central portion of base 142 such that a significant portion of base 142 lies forwardly of the distal end of section 88 and such that a significant portion of base 142 lies rearwardly of the distal end of section 88.

Figure 6E:
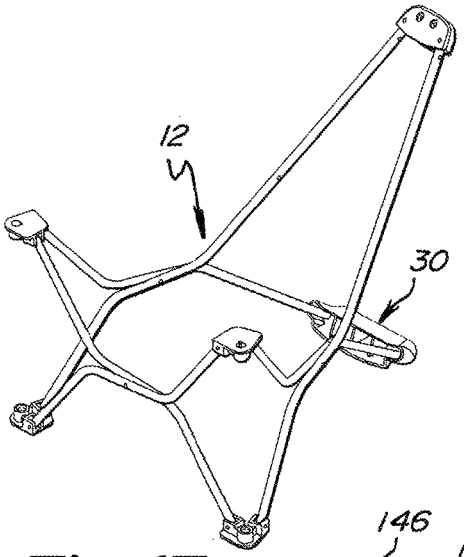
FIG. 6E is a small view of the infant lounger of FIG. 1 for reference when considering FIGS. 6A, 6B, 6C, and 6D.
Figure 6A:
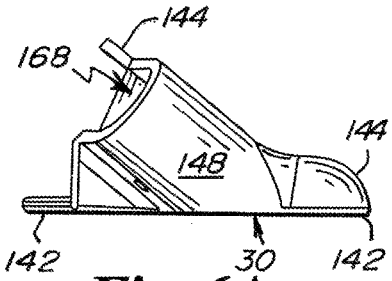
FIG. 6A is a side detail view of a second hub or connection for the frame of the infant lounger of FIG. 1.
Figure 6B:
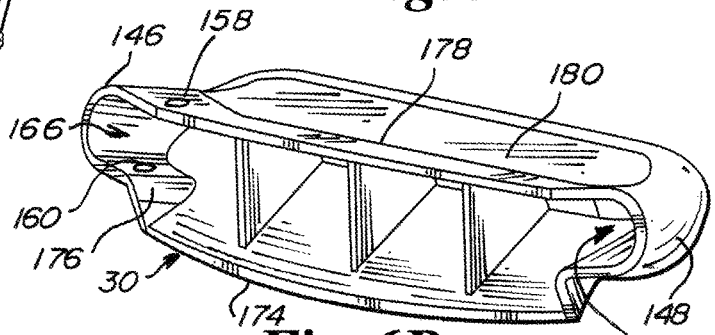
FIG. 6B is a front perspective detail view of the second hub or connection of FIG. 6A.

Section 98 of support member 44 includes an axis. As shown in FIG. 6A, this axis intersects base 142 intermediate of a front end and rear end of base 142. This axis intersects base 142 at a central portion of base 142 such that a significant portion of base 142 lies forwardly of the distal end of section 98 and such that a significant portion of base 142 lies rearwardly of the distal end of section 98.

Lower plate portions 152 and 156 are supported relative to the base 142 by triangular plate portions 176, 178, respectively, that extend integrally between the lower plate portions 152, 156 and the base 142.

Figure 6C:
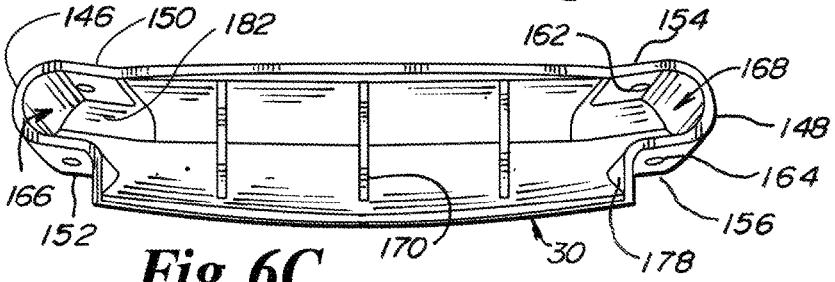
FIG. 6C is a front elevation detail view of the second hub or connection of FIG. 6B.
Figure 6D:
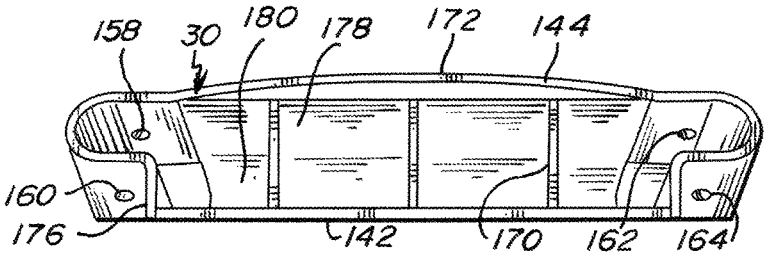
FIG. 6D is a front elevation detail view of the second hub or connection of FIG. 6B taken from a slightly lower elevation than the view seen in FIG. 6C.

Ceiling 144 includes upper plate portions 150, 154. Rearwardly of each of plate portions 150, 154, ceiling portion 182 of ceiling 144 undulates to the base 142, as shown in FIG. 6A and FIG. 6C.

Ceiling 144 includes an elongate plate portion 178 extending to and between the upper plate portions 150, 154 and extending rearwardly from the overhang 170. Rearwardly of the elongate plate portion 178, a curved portion 180 of the ceiling 144 extends to the base 142.

Lower plate portions 152, 156 lead directly into base 142. Upper plate portions 150, 154 are spaced from the base 142 by ceiling portion 182 that undulates to the base 142. As shown in FIG. 6C, a lower half of each of cylindrical portions 146, 148 leads directly into the base 142. The upper half of each of cylindrical portions 146, 148 leads into ceiling portion 182.

Lower rear hub 30 includes a first distance. A second distance is a distance between the center of front lower hub 22 and the center of front lower hub 24. The first distance is about one-third to one-half the second distance such that hub 30 is elongate in a transverse direction to provide stability to the lounger 10.

Figure 7D:
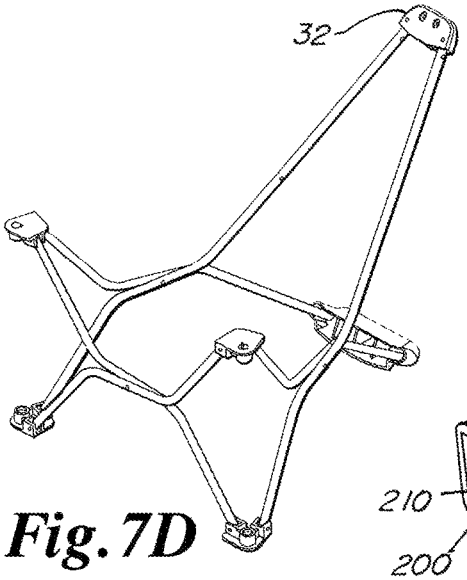
FIG. 7D is a small view of the infant lounger of FIG. 1 for reference when considering FIGS. 7A, 7B, and 7C.
Figure 7A:
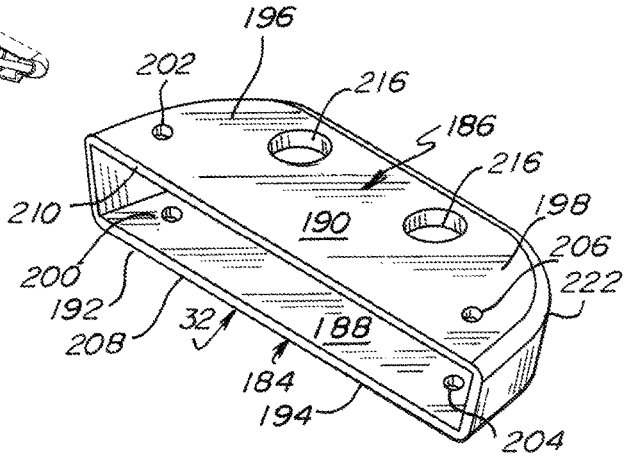
FIG. 7A is a perspective detail view of a third hub or connection for the frame of the infant lounger of FIG. 1.
Figure 7B:
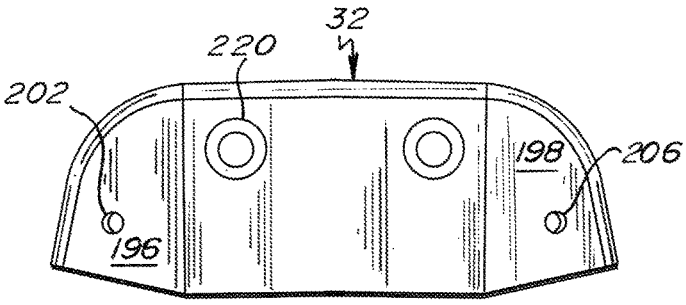
FIG. 7B is a top detail view of the third hub or connection of FIG. 7A.
Figure 7C:
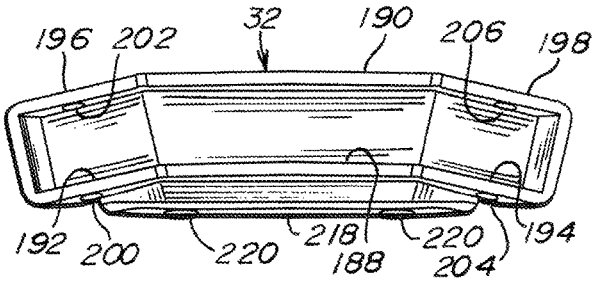
FIG. 7C is a rear elevation detail view of the third hub or connection of FIG. 7A.

FIGS. 7A, 7B and 7C show the upper rear hub 32. Upper rear hub 32 includes a base 184 and a ceiling 186.

Base 184 includes a horizontal plate portion 188 and ceiling 186 includes a horizontal plate portion 190. The portions 188, 190 are disposed parallel to each other.

Base 184 includes a first oblique plate portion 192 and a second oblique plate portion 194, where such plate portions 192, 194 are oblique relative to horizontal plate portion 188.

Ceiling 186 includes a first oblique plate portion 196 and a second oblique plate portion 198, where such plate portions 196, 198 are oblique relative to horizontal plate portion 190.

Base oblique plate portion 192 and ceiling oblique plate portion 196 are disposed parallel to each other as shown in FIG. 7C. Base oblique plate portion 194 and ceiling oblique plate portion 198 are disposed parallel to each other as shown in FIG. 7C.

A first pivot pin 212 extends from an opening 200 in base oblique plate portion 192 to opening 202 in ceiling oblique plate portion 196 and pivotally engages the upper end of section 76 of support member 38. A second pivot pin 214 extends from an opening 204 in base oblique plate portion 194 to opening 206 in ceiling oblique plate portion 198 and pivotally engages the upper end of section 86 of support member 40.

The first pivot pin 212 engaging openings 200, 202 is oblique in two ways. First, such first pivot pin 212 is oblique relative to the each of the planes of plate portions 192 and 196. This can be seen by observing that opening 200 is further back from front edge 208 than opening 202 is from front edge 210. Second, such first pivot pin 212 is oblique relative to plate portions 188, 190. This can be seen in FIG. 7C.

The second pivot pin 214 engaging openings 204, 206 is oblique in two ways. First, such second pivot pin 214 is oblique relative to the each of the planes of plate portions 194 and 198. This can be seen by observing that opening 204 is further back from front edge 208 than opening 206 is from front edge 210. Second, such second pivot pin 214 is oblique relative to plate portions 194, 198. This can be seen in FIG. 7C.

Relative to each other, the pivot pins 212, 214 are not parallel. The pivot pins 212, 214 extend obliquely relative to each other.

Relative to a horizontal plane such as a surface upon which the lounger 10 rests, it can be appreciated that axes of pivot pins 167, 169 converge obliquely upwardly and obliquely inwardly. Such can be seen by comparing FIG. 6D with FIG. 6E.

Relative to a horizontal plane such as a surface upon which the lounger 10 rests, it can be appreciated that the axes of pivot pins 212, 214 diverge obliquely upwardly and obliquely outwardly.

Central plate portion 190 of ceiling 186 includes a pair of front connector openings 216 for engaging seat 46. The front connector openings 216 may extend through central plate portion 188 of base 184. A sub-base 218 includes rear connector openings 220 that may or may not communicate with front connector openings 216.

Base 184 and ceiling 186 are joined and spaced apart by a C-shaped sidewall 222. The upper ends of the sections 76, 86 extend between the base 184 and ceiling 186.

Sub-base 218 is generally a box-like structure integral with base 184. Sub-base 218 provides a platform for rear connector openings 220. Sub-base 218 provides a support or brace among and to the three plate portions 188, 192, and 194 of base 184.

FIGS. 8A and 8B show the frame 12 in the folded in and compact position. Front upper hubs 26, 28 are adjacent to each other. Lower front hubs 22, 24 and lower rear hub 30 are adjacent to each other. Lower rear hub 30 is disposed at a first elevation. Lower front hubs 22, 24 are disposed at a second elevation higher than the first elevation. Upper front hubs 26, 28 are disposed at a third elevation higher than the second elevation. Upper rear hub 32 is disposed at a fourth elevation higher than the third elevation.

FIGS. 8A and 8B show that front upper hubs 26, 28 are adjacent to sections 76, 86 and that, in particular, hub 26 is adjacent to section 76 and hub 28 is adjacent to section 86.

FIG. 9 shows seat 46 having a first pin 224 for engaging opening 114 of the first front upper hub 26 and a second pin 226 for engaging opening 114 of second front upper hub 28. Seat 46 includes two further pins 230, 232, shown in phantom in FIG. 9, for engaging rear openings 220 of the upper rear hub 32.

Seat 46 includes a perimeter reinforcing strap 228 that extends endlessly about the seat 46. Seat 46 further includes a pair of flexible reinforcing corner pieces 234 and 236 where the pins 224, 226 engage the seat 46 and the upper front hubs 26, 28.

Inwardly from the perimeter strap 228, seat 46 includes a secondary inner perimeter 238 having a width wider than perimeter strap 228. Disposed inwardly of the secondary perimeter 238 is seat portion 240 having a seat section 242 for an infant's rear end and legs, a back section 244 for an infant's back, and side sections 246.

The seat 46 is stretched taut between the upper front hubs 26, 28 in the open and folded out position such that support members 34 and 36 are prevented from further pivoting in one direction. However, the support members 34, 36 may pivot in the opposite direction such that the lounger 10 may be folded to the folded in and compact form shown in FIGS. 8A, 8B and 11. The seat 46, namely the perimeter strap 228 and secondary perimeter section 238, is also taut between front upper hub 26 and upper rear hub 32. The seat 46, namely the perimeter strap 228 and secondary perimeter section 238, is also taut between second front upper hub 28 and upper rear hub 32. Sections 242, 244 and 246 depend from secondary perimeter section 238. Seat 46 may be permanently or removably engaged to frame 12.

FIG. 10 shows the lounger 10 of FIG. 9 with an endless flexible skirt 248 engaged, such as by stitching, to the perimeter strap 228. FIG. 10 further shows that the lounger 10 may have a head rest or pillow 250 engaged to the seat 46, such as by stitching, and at a location over the upper rear hub 32 to isolate the upper rear hub 32 from the head of an infant.

Figure 11:
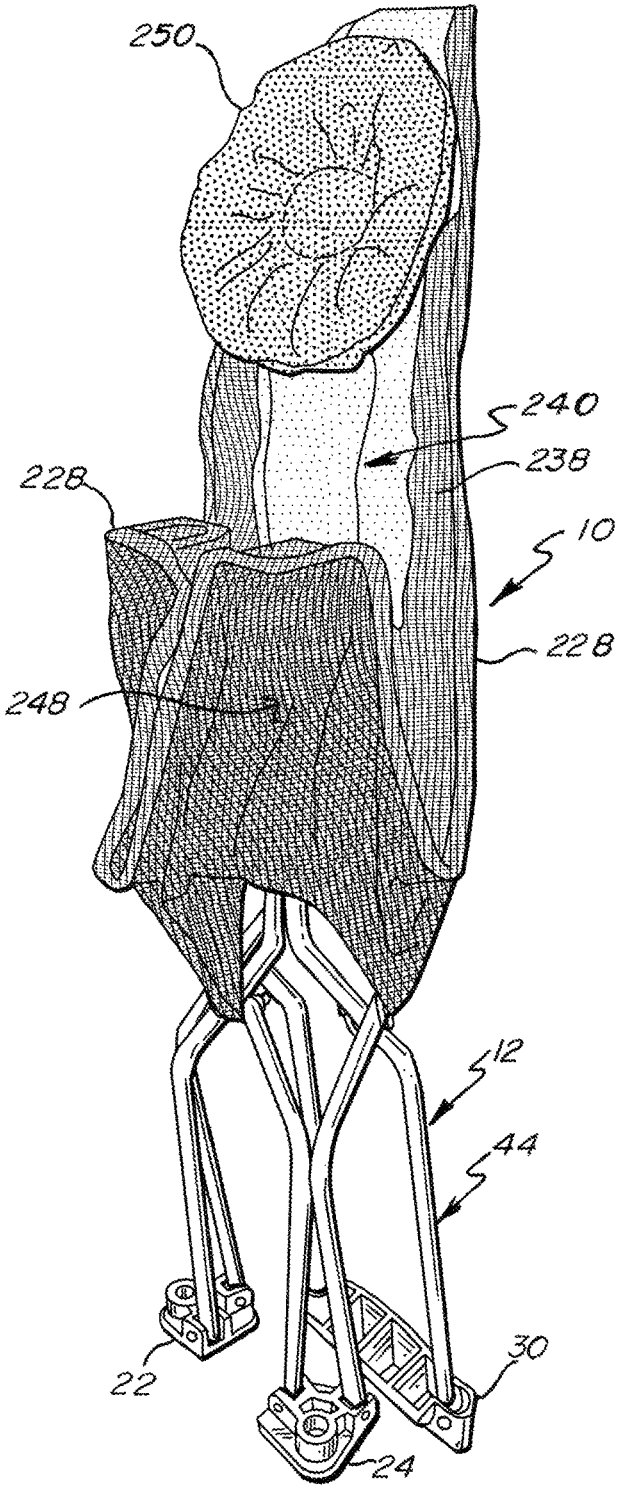
FIG. 11 is a perspective view of the infant lounger of FIG. 10 where the infant lounger frame is in a collapsed form.

FIG. 11 shows that the lounger 10 and frame 12 can fold in to the folded in and compact position with the seat 46, skirt 248 and head rest 250 engaged.

In operation, the lounger 10 may be opened from the folded in and compact position shown in FIGS. 8A, 8B and 11 to an open and operation position shown, for example, in FIGS. 1, 9 and 10 by first taking hold of first upper front hub 26 with one hand and second upper front hub 28 with the other hand. Then the hubs 26, 28 are drawn apart, an action that will simultaneously a) draw apart the first lower front hub 22 and second lower front hub 24 by a scissoring of support members 34 and 36, b) draw apart the second lower front hub 24 and rear lower hub 30 by a scissoring of support members 40, 44, c) draw apart the first lower front hub 22 and rear lower hub 30 by a scissoring of support members 38 and 42, d) draw apart the first upper front hub 22 and upper rear hub 32 by a scissoring of support members 38 and 42, and e) draw apart the second upper front hub 28 and the upper rear hub 32 by a scissoring of support members 40, 44. The flexible seat 46 works as a stop to prevent folding beyond a predefined position. Then an infant may be placed in the seat portion 240 and rest stably and securely therein, with the lounger 10 having two front hubs 22, 24 working as feet and an elongate lower rear hub 30 that is elongate in the lateral direction, which is the direction from lower front hub 22 to lower front hub 24. Then, after the infant is taken out of the lounger 10, the lounger may be folded from the open and operating position shown, for example, in FIGS. 1, 9 and 10 to the folded in and compact position shown in FIGS. 8A, 8B and 11, by first taking hold of first upper front hub 26 with one hand and second upper front hub 28 with the other hand. Then the hubs 26, 28 are pushed toward each other, an action that will simultaneously a) push the first lower front hub 22 and second lower front hub 24 toward each other by a scissoring of support members 34 and 36, b) push the second lower front hub 24 and rear lower hub 30 toward each other by a scissoring of support members 40, 44, c) push the first lower front hub 22 and rear lower hub 30 toward each other by a scissoring of support members 38 and 42, d) push the first upper front hub 22 and upper rear hub 32 toward each other by a scissoring of support members 38 and 42, and e) push the second upper front hub 28 and the upper rear hub 32 toward each other by a scissoring of support members 40, 44.

Figure 13A:
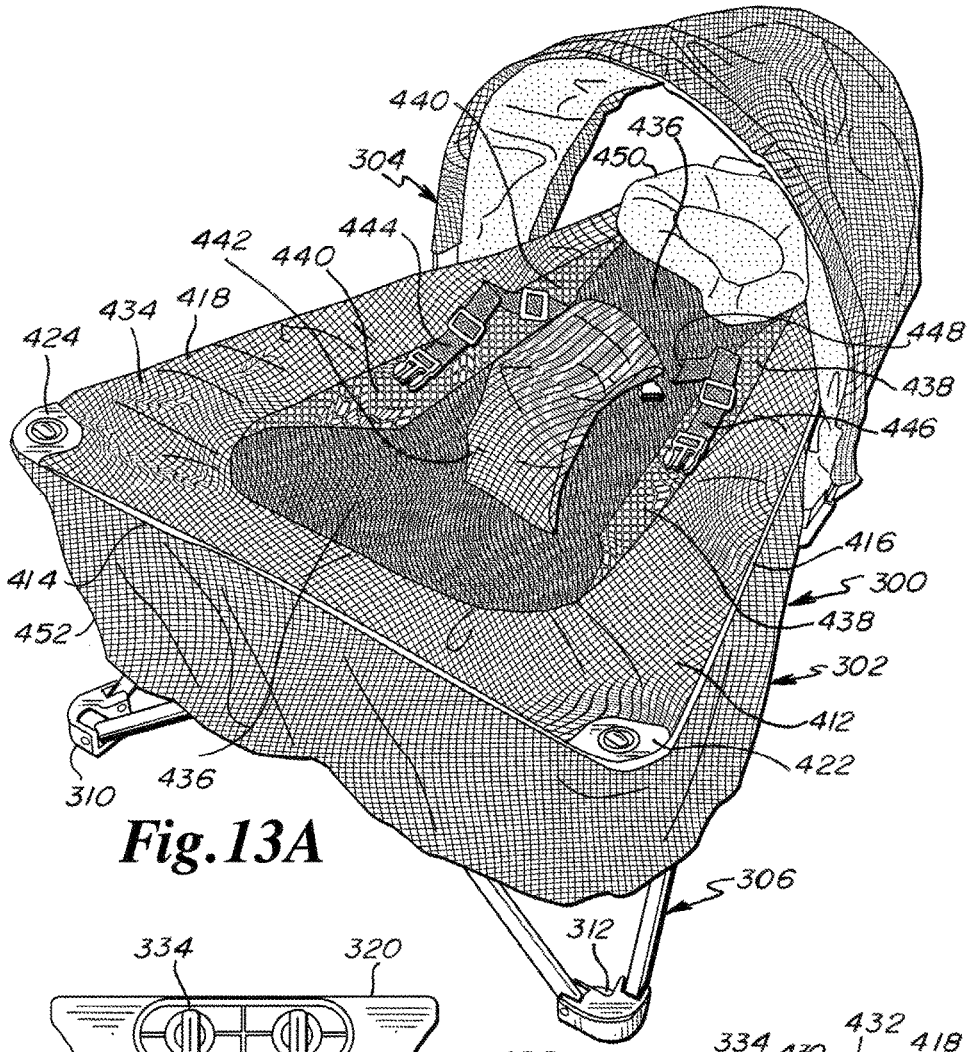
FIG. 13A is a perspective view of the second embodiment of FIG. 12 where flexible sheeting or soft material is engaged on the frame and where the infant lounger includes a canopy.
Figure 13B:
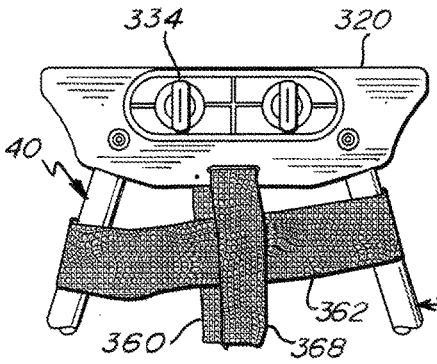
FIG. 13B is a rear view of a rear portion of the frame prior to the flexible sheeting being engaged to the frame.

A second embodiment of the infant lounger is shown in FIG. 13A and is designated by reference number 300.

Infant lounger 300 includes soft, flexible bedding 302, a canopy 304, and a frame 306.

Figure 12:
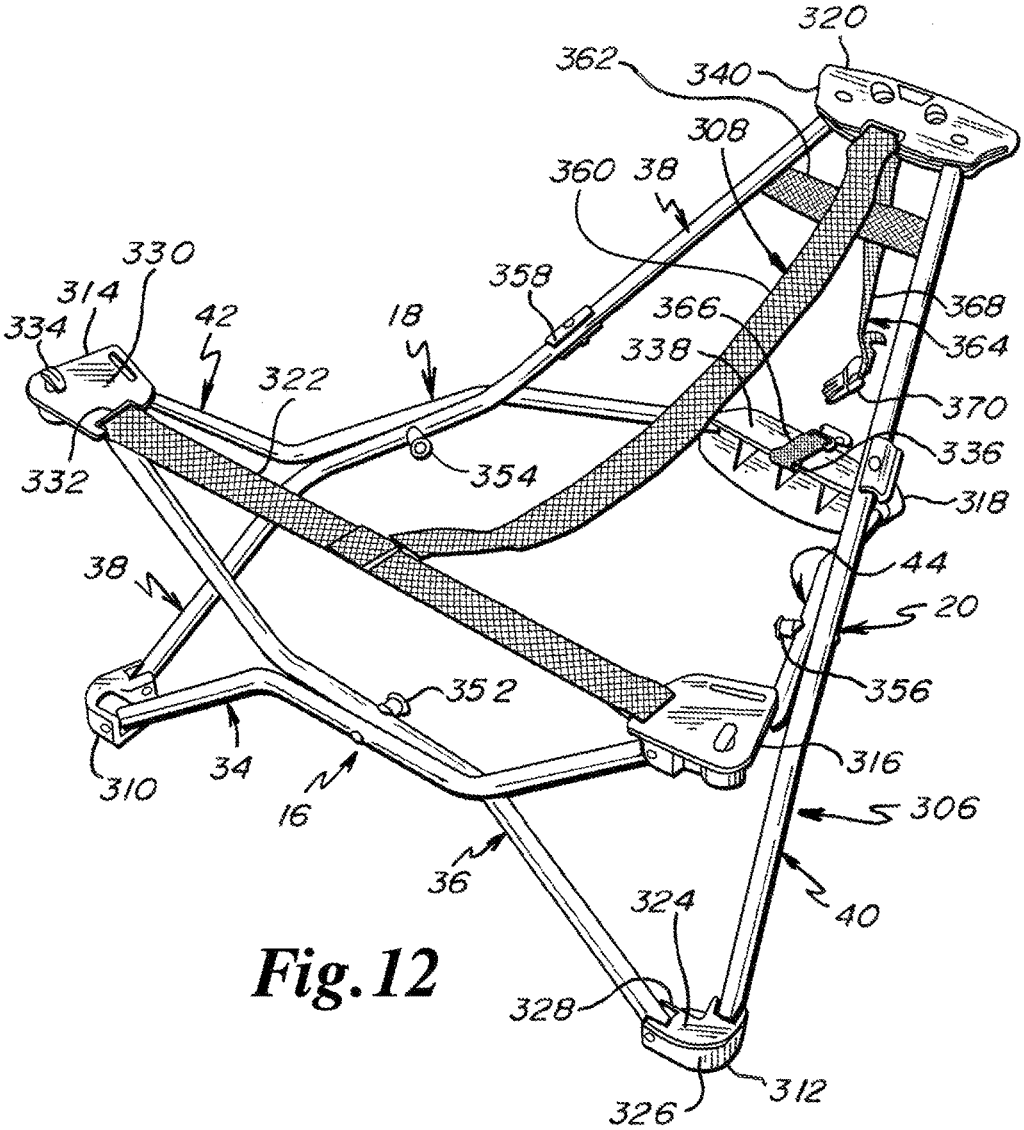
FIG. 12 is a perspective view of a second embodiment of the frame of the infant lounger of FIG. 1.

Frame 306 is shown in FIG. 12. Frame 306 is identical to frame 12 of FIG. 1 except that frame 306 includes strapping 308 and other further elements as will be discussed below.

Frame 306 is a three pivot point foldable frame. Frame 306 is generally in the form of a seat. Frame 306 includes the first pivot point or pivot 16, the second pivot point or pivot 18 and the third pivot point or pivot 20.

Frame 306 includes first and second lower front hubs 310, 312, first and second upper front hubs 314, 316, lower rear hub 318, an upper rear hub 320.

Frame 306 includes the first support member 34 extending between the first lower front hub 310 and the second upper front hub 316, a second support member 36 extending between the second lower front hub 312 and first upper front hub 314, a third support member 38 extending between the first lower front hub 310 and the upper rear hub 320, a fourth support member 40 extending between the second lower front hub 312 and the upper rear hub 320, a fifth support member 42 extending between the first upper front hub 314 and the lower rear hub 318, a sixth support member 44 extending between the second upper front hub 316 and the lower rear hub 318.

The first and second support members 34, 36 are pivotally engaged to each other at the first pivot 16. The third and fifth support members 38, 42 are pivotally engaged to each other at the second pivot 18. The fourth and sixth support members 40, 44 are pivotally engaged to each other at the third pivot 20.

As shown in FIGS. 1, 2A, 3A, 4A, 9 and 10, the three pivot point foldable frame 12 includes a folded out and operating position. Frame 306 also includes this folded out and operating position.

As shown in FIGS. 8A and 8B, the three pivot point foldable frame 12 includes a folded in and compact position. Frame 306 also includes this folded in and compact position.

In the folded in and compact position, the first and second lower front hubs 310, 312 are adjacent to each other, the first and second upper front hubs 314, 316 are adjacent to each other, and the lower rear hub 318 is adjacent to the first and second lower front hubs 310, 312.

In the folded out and operating position, the first lower front hub 310 is closer to the first upper front hub 314 than the second lower front hub 312, and the second lower front hub 312 is closer to the second upper front hub 316 than the first lower front hub 310.

In the folded out and operating position, each of the first, second, third, fourth, fifth, and sixth support members 34, 36, 38, 40, 42, and 44 of each of frames 12 and 306 generally forms the shape of an "S." In the folded out and operating position, as to each of the frames 12 and 306, the first and second support members 34, 36, in combination, form generally the shape of an upper case "H."

As to each of frames 12 and 306, in the folded out and operating position, the third and fifth support members 38, 42, in combination, form generally the shape of a lower case "h."

As to each of frames 12 and 306, in the folded out and operating position, the fourth and sixth support members 40, 44, in combination, form generally the shape of a lower case "h"

As to each of the frames 12 and 306, each of the first, second, third, fourth, fifth, and sixth support members 34, 36, 38, 40, 42, and 44 includes a middle section, a lower section and an upper section. Each of such middle, lower and upper sections is straight. Each of such lower sections is disposed obliquely relative to its respective middle section. Each of such upper sections is disposed obliquely relative to its respective middle section.

As to each of the frames 12 and 306, each of the first, second, third, fourth, fifth, and sixth support members 34, 36, 38, 40, 42, and 44 includes first and second transition sections. Each of the first and second transition sections is curved. The first transition section is disposed between its respective lower section and middle section. The second transition section is disposed between its respective upper section and middle section.

As to each of the frames 12 and 306, the upper section of the third support member 38 has a greater length than the lower section of the third support member 38, and the upper section of the fourth support member 40 has a greater length than the lower section of the fourth support member 40.

As to each of the frames 12 and 306, the lower section of the fifth support member 42 has a greater length than the upper section of the fifth support member 42, and the lower section of the sixth support member 44 has a greater length than the upper section of the sixth support member 44.

As to each of the frames 12 and 306, the upper sections of the third and fourth support members 38, 40 converge toward each other as the upper sections of the third and fourth support members 38, 40 extend toward the respective upper rear hub 32, 320.

As to each of the frames 12 and 306, the lower sections of the fifth and sixth support members 42, 44 converge toward each other as the lower sections of the fifth and sixth support members 42, 44 extend toward the respective lower rear hub 30, 318.

As to each of the frames 12 and 306, the lower sections of the third and fourth support members 38, 40 diverge away from each other as such lower sections of the third and fourth support members 38, 40 extend toward the first and second lower front hubs 22, 24 of frame 12 or the second lower front hubs 310, 312 of frame 306.

As to each of the frames 12, 306, the upper sections of the fifth and sixth support members 42, 44 diverge away from each other as such upper sections of the fifth and sixth support member 42, 44 extend toward the first and second upper front hubs 26, 28 of frame 12 or the first and second upper front hubs 314, 316 of frame 306.

As to each of the frames 12, 306, the third and fourth support members 38, 40 include upper ends spaced apart from each other by a first distance and engaging respective hub 32, 320, and the fifth and sixth support members 38, 40 include lower ends spaced apart from each other by a second distance and engaging lower front hubs 22, 24 of frame 12 or lower front hubs 310, 312 of frame 306, with such second distance being greater than such first distance.

As to each of frames 12, 306, in the folded in and compact position, the respective lower rear hub 30, 318 is disposed at a base elevation, the first and second lower front hubs 22, 24 of frame 12 or first and second lower hubs 310, 312 of frame 306 are disposed at a second elevation greater than the base elevation, the first and second upper front hubs 26, 28 of frame 12 or the first and second upper front hubs 314, 316 of frame 306 are disposed at a third elevation greater than the second elevation, and the respective upper rear hub 32, 320 is disposed at a fourth elevation greater than the third elevation.

Like frame 12, frame 306 includes a first pivotal engagement at the first lower front hub 310 between the first lower front hub 310 and the first support member 34 that defines a first pivot axis and a second pivotal engagement at the first lower front hub 310 between the first lower front hub 310 and the third support member 38 that defines a second pivot axis. These first and second pivot axis define an oblique angle.

The lounger 300 includes bedding 302. Flexible bedding 302 is engaged to the first and second upper hubs 314, 316 and the upper rear hub 320, and may further be engaged to strapping 308. Bedding 302 is formed of a flexible sheeting material.

Strapping 308 is engaged to and between the first and second upper hubs 314, 316, where, in the folded out and operating position such as shown in FIG. 12, a section 322 of the strapping 308 is taut such that the first and second support members 34, 36 are prevented from pivoting relative to each other in one direction and such that, when the first and second support members 34, 36 pivot relative to each other in the other direction, the strapping section 322 folds.

Frame 306 includes support members 34, 36, 38, 40, 42, 44. Each of the support members 34, 36, 38, 40, 42, 44 is integral and one-piece. Each of the support members is tubular and formed of a metal such as steel or aluminum.

Like frame 12, support member 34 of frame 306 includes, from bottom to top, lower section 48, transition section 50, middle section 52, transition section 54, and upper section 56.

Like frame 12, support member 36 of frame 306 includes, from bottom to top, lower section 58, transition section 60, middle section 62, transition section 64, and upper section 66.

Like frame 12, support member 38 of frame 306 includes, from bottom to top, lower section 68, transition section 70, middle section 72, transition section 74, and upper section 76.

Like frame 12, support member 40 of frame 306 includes, from bottom to top, lower section 78, transition section 80, middle section 82, transition section 84, and upper section 86.

Like frame 12, support member 42 of frame 306 includes, from bottom to top, lower section 88, transition section 90, middle section 92, transition section 94, and upper section 96.

Like frame 12, support member 44 of frame 306 includes, from bottom to top, lower section 98, transition section 100, middle section 102, transition section 104, and upper section 106.

Like frame 12, support members 34, 36, 38, 40, 42, and 44 of frame 306 and hubs 310, 312, 314, 316, 318 and 320 of frame 306 provide an endless train. In other words, the endless train runs from first lower front hub 310 to support member 34 to second upper front hub 316 to support member 44 to lower rear hub 318 to support member 42 to first upper front hub 314 to support member 36 to second lower front hub 312 to support member 40 to upper rear hub 320 to support member 38 and back to first lower front hub 310.

As in frame 12, support member 40 of frame 306, extending from second lower front hub 312 to upper rear hub 320, lies outside of support member 44. Support member 38 of frame 306, extending from first lower front hub 310 to upper rear hub 320, lies inside of support member 42.

As in frame 12, support member 34 of frame 306, extending from first lower front hub 310 to second upper front hub 316, lies outside of support member 36 that extends from second lower front hub 312 to first upper front hub 314.

As in frame 12, support members 34 and 36 of frame 306 are front support members and extend between the front hubs 310, 312, 314, 316.

As in frame 12, support members 40 and 44 of frame 306 are left side support members and are disposed on the left side of the lounger 300, relative to an infant laying on his or her back in the bedding 302 of the lounger 300. Hubs 312, 316 are, likewise, left side hubs.

As in frame 12, support members 38 and 42 of frame 306 are right side support members and are disposed on the right side of the lounger 300, relative to an infant laying on his or her back in the bedding 302 of the lounger 300. Hubs 310, 314 are, likewise, right side hubs.

As in frame 12, the right side lower and upper front hubs 310, 314 of frame 306 are disposed, in the open and operating configuration, directly vertical of the other. As in frame 12, the left side lower and upper front hubs 312, 316 of frame 306 are disposed, in the open and operating configuration, directly vertical of the other.

As in frame 12, the front lower hubs 310 and 312 and the lower rear hub 318 of frame 306 have undersides or floors that define a plane when the frame 306 is in the open and operating configuration. In the open and operating position, strap section 322 has been drawn tight by the scissoring of frame 306 and strap section 322 prevents further scissoring or folding of frame 306 and prevents the upper hubs 314, 316, 320 from being drawn further closer to respective lower hubs 310, 312, 318.

Frame 306 is like frame 12 in FIGS. 2A and 3A that show that a center of rear lower hub 318 and a center of upper rear hub 320 of frame 306 are laterally offset from each other relative to a vertically extending longitudinal plane. In other words, a longitudinal vertical plane passing through the center of upper rear hub 320 does not include the center of lower rear hub 318. Likewise, a longitudinal vertical plane passing through the center of lower rear hub 318 does not include the center of upper rear hub 320.

As with frame 12, each of the support members 34, 36, 38, 40, 42, 44 of frame 306 lies in and defines its own plane. That is, each of the lower, middle, upper and transition sections of each of the support members 34, 36, 38, 40, 42, and 44 of frame 306 lies in and defines its own plane.

As with frame 12, from a top plan view, frame 306 is generally a three sided structure, where one or more support members 34, 36 make up a first side, where one or more support members 38 and 42 make up a second side, and where one or more support members 40, 44 make up a third side.

Frame 306 is like frame 12 in FIG. 4A that shows that the lower rear hub 318 is longitudinally offset from the upper rear hub 320 relative to a laterally extending vertical plane. In other words, a lateral vertical plane passing through a central portion of the lower rear hub 318 does not include a central portion of the upper rear hub 320. Likewise, a lateral vertical plane passing through a central portion of upper rear hub 320 does not include a central portion of lower rear hub 318.

As with frame 12, the upper rear hub 320 of frame 306 is disposed rearwardly of lower rear hub 318.

As with upper sections 76, 86 of frame 12 and upper sections 96, 106 of frame 12, upper sections of members 38, 40 of frame 306, where such upper sections are adjacent upper rear hub 320, are disposed at an angle closer to the horizontal than are upper sections of members 42, 44 where such upper sections are adjacent to upper front hubs 314, 316, where pivot 20 lies in a first horizontal plane and such angle is defined relative to the first horizontal plane.

As with lower sections 88, 98 of frame 12, lower sections 88, 98 of members 42, 44 of frame 306, where such lower sections are adjacent to rear lower hub 318, are disposed at an angle closer to the horizontal than are lower sections 68, 78 of members 38, 40 of frame 306, where such lower sections are adjacent to front lower hubs 310, 312 of frame 306, where pivot 20 lies in a first horizontal plane and such angle is defined relative to the first horizontal plane.

Lower front hubs 310, 312 of frame 306 are identical to lower front hubs 22, 24 of frame 12 with respect to how the hubs 310, 312 engage and relate to the respective support members 34, 38 and support members 36, 40.

Each of the lower front hubs 310, 312 of frame 306 includes a base that defines a plane. The base includes a flat under face that confronts the surface on which the infant lounger 300 rests. Each of the lower front hubs 310, 312 includes walls that project from the base and are integral with the base. Some of these walls are opposing walls that receive therebetween an end of support members 34, 36, 38, 40 of frame 306. Such opposing walls receive and engage a horizontally oriented pin that also engages the lower end of the respective support member 34, 36, 38, 40. Front lower hub 310 pivotally fixes the support members 34, 38 at an oblique angle, specifically at an acute angle. Front lower hub 312 pivotally fixes the support members 36, 40 at an oblique angle, specifically at an acute angle. Each of the lower hubs 310, 312 includes a top cover 324, an outer U-shaped sidewall 326, and an inner V-shaped sidewall 328. Cover 324 extends between sidewalls 326, 238. Cover 324 and sidewalls 326, 328 enclose any internal ribs or walls such as shown with respect to front lower hubs 22, 24 of frame 12.

Upper front hubs 314, 316 of frame 306 are identical to upper front hubs 26, 28 of frame 12 with respect to how the hubs 314, 316 engage and relate to the respective support members 34, 38 and support members 42, 44.

Each of the upper front hubs 314, 316 of frame 306 includes a base 330. Walls depend from the base 330 and are identical to the walls shown in FIGS. 5A, 5B, 5C, and 5E. These walls that project from the base 330 are integral and one-piece with the base 330. Some of these walls are opposing walls that receive therebetween an end of support members 34, 36, 42, 44 of frame 306. Such opposing walls receive and engage a horizontally oriented pin that also engages the lower end of the respective support member 34, 36, 42, 44. Front upper hub 314 pivotally fixes the support members 36, 42 at an oblique angle, specifically at an acute angle. Front upper hub 316 pivotally fixes the support members 34, 44 at an oblique angle, specifically at an acute angle.

Upper front hub 314 includes a slot 332 formed in an inner end portion of the base 330 of the hub 314. Upper front hub 316 includes slot 332 formed in an inner end portion of the base 330 of hub 316. Strap section 322 is engaged in the slots 332. Each of the ends of the strap section 322 includes a looped portion that passes through slot 332.

Each of the upper front hubs 314 includes a pin 334 with a head on a shaft. The pin 334 is rotatable for 90 degrees in its respective hub 314, 316 such that the head of the pin 334 rotates for 90 degrees. The head of the pin 334 is spaced from the upper face of the base 330 to receive therebetween a portion of one of the hub connections 422, 424 and a portion of bedding 302. Pin 334 is engaged in the outer and front corner portion of the base 330 of the respective hub 314, 316. A pair of pins 334 is engaged in upper rear hub 320 and are accessible from the rear of the upper rear hub to engage the pair of integral hub connections 426 set side by side in a rear portion of bedding 302.

Lower rear hub 318 of frame 306 is identical to the lower rear hub 30 of frame 12 with the exception of a slot 336 for strapping 308. Slot 336 is formed in a front middle portion of the ceiling or upper plate portion 338 of lower rear hub 318 and in front of the middle upright brace extending between the base or floor or lower plate portion and the ceiling or upper plate portion 338 of the lower rear hub 318. Lower rear hub 318 pivotally engages distal end portions of support members 42, 44. The distal ends of support members 42, 44 in lower rear hub 318 pivot on axis that do not extend parallel to each other. The distal ends of support members 42, 44 in lower rear hub 318 pivot on axis that extend obliquely to each other. Lower rear hub 318 is integral and one-piece and is a molded structure.

Upper rear hub 320 of frame 306 is identical to the upper rear hub 30 of frame 12 with the exception of the shape of the periphery 340 of upper rear hub 320, with the exception of first and second slots 342, 344 formed in the upper rear hub 320, and with the exception of a pair of rotatable pins 334. The periphery 340 of upper rear hub 320 includes tapered or flared ends that taper outwardly and upwardly. First and second slots 342, 344 are formed in respective lower and upper plate portions 348, 350 of the upper rear hub 320. First and second slots 342, 344 engage strapping 308. Each of the rotatable pins 334 includes a shaft and head. Each of the pins 334 is rotatable for 90 degrees such that the head of each of the pins 334 rotates for 90 degrees. The head of each of the pins 334 is spaced from the outer face of the lower plate portion 348 to permit the head to engage bedding 302. Distal end portions of support members 38, 40 are pivotally engaged to upper rear hub 320. The distal ends of support members 38, 40 in upper rear hub 320 pivot on axis that do not extend parallel to each other. The distal ends of support members 38, 40 in upper rear hub 320 pivot on axis that extend obliquely to each other. Upper rear hub 320 is integral and one-piece and is a molded structure. Relative to a horizontal plane such as a surface upon which the lounger 10 rests, it can be appreciated that the respective axis that the upper distal ends of support members 38, 40 pivot upon in upper rear hub 320 converge obliquely upwardly and obliquely inwardly. Such can be seen by comparing FIG. 6D with FIG. 6E since upper rear hub 320 of frame 306 is identical to upper rear hub 32 of frame 12 in how the hubs 32, 320 relate structurally and functionally to the frames 12, 306 and to the upper distal ends of support members 38, 40. Relative to a horizontal plane such as a surface upon which the lounger 300 rests, it can be appreciated that the respective axis that the upper distal ends of support members 38, 40 pivot upon in upper rear hub 320 diverge obliquely upwardly and obliquely outwardly.

Frame 306 includes a folded in and compact position just like frame 12 is shown in a folded in and compact position in FIGS. 8A and 8B. In such folded in and compact position of the frame 306: front upper hubs 314, 316 are adjacent to each other; lower front hubs 310, 312 and lower rear hub 318 are adjacent to each other; lower rear hub 318 is disposed at a first elevation; lower front hubs 310, 312 are disposed at a second elevation higher than the first elevation; upper front hubs 314, 316 are disposed at a third elevation higher than the second elevation; and upper rear hub 320 is disposed at a fourth elevation higher than the third elevation.

Frame 306 includes a set of three inwardly extending pins 352, 354, 356. Pins 352, 354, 356 are nonrotatably fixed to the frame 306 at respective pivot locations 16, 18, 20. Each of the pins 352, 354, 356 includes a shaft and a head. Each of the pins 352, 354, 356 serves as a base for an elastic loop 454 that extends from bedding 302 to the respective pin 352, 354, 356.

At pivot location 16 a washer is disposed on the pivot pin between support members 34, 36 to space apart support members 34, 36. At pivot location 18 a washer is disposed on the pivot pin between support members 38, 42 to space apart support members 38, 42. At pivot location 20 a washer is disposed on the pivot pin between support members 40, 44 to space apart support members 40, 44. Such spacing apart of such paired support members by the washers maximizes swinging of the paired support members relative to each other, maximizes an easy folding or scissoring of frame 306 as a whole, and minimizes friction between such paired support members.

Frame 306 includes a connection base 358 for engaging the canopy 304 to frame 306. A first connection base 358 is nonrotatably and nonslidingly fixed to support member 38. A second connection base 358 is nonrotatably and nonslidingly fixed to support member 40. First connection base 358 is engaged on support member 38 between pivot location 18 and the distal upper end of support member 38. Second connection base 358 is engaged on support member 40 between pivot location 20 and the distal upper end of support member 40.

Strapping 308 includes strap section 322 engaged to and extending laterally between upper front hubs 314, 316. Strap section 322 prevents all support members 34, 36, 38, 40, 42, 44 from scissoring further in a first direction, with such first direction being the direction of folding that draws front upper hub 314 and front lower hub 310 together and that draws front upper hub 316 and front lower hub 312 together. Strap section 322 permits all support members 34, 36, 38, 40, 42, 44 to fold or scissor in a second direction, with such second direction being the direction of folding that draws front upper hub 314 and front lower hub 310 apart and that draws front upper hub 316 and front lower hub 312 apart. Strap section 322 also supports bedding 302 and an infant in bedding 302.

Strapping 308 includes strap section 360. Strap section 360 extends longitudinally between a middle portion of strap section 322 and the upper rear hub 320. Strap section 360 includes a proximal end portion that is fixedly engaged to the middle portion of strap section 322 and a distal end portion that is engaged to upper rear hub 320. Strap section 360 terminates at the upper rear hub 320. The distal end portion of strap section 322 includes a looped portion that is engaged in slot 342 of upper rear hub 320. When strap section 322 is taut, i.e., when the frame 306 is in the folded out and operating position, strap section 360 is loose and bowed when there is no weight on bedding 302, i.e., when there is no infant in the bedding 302. When strap section 322 is taut, i.e., when the frame 306 is in the folded out and operating position, strap section 360 is taut when there is weight on bedding 302, i.e., when there is an infant in the bedding 302. When frame 306 is folded from the open and operating position to the closed position, strap section 360 becomes even further relaxed because the distance from the middle of strap section 322 to the upper rear hub 320 decreases.

Strapping 308 includes a second laterally extending strap section 362. Strap section 362 extends between upper end portions of support members 38, 40 and runs adjacent to upper rear hub 320. Strap section 362 includes two ends, with each of the ends being a looped end that slidingly engages its respective support member 38, 40. Strap section 362 includes a middle portion that fixedly engages, such as by stitching, strap section 360. Strap section 362 supports bedding 302. Strap section 362 is also support for strap section 360 and works in combination with the upper rear hub 320 in providing support for strap section 360. If desired, second or third or further lateral strap sections, such as strap sections 362, can extend between support members 38, 40. If desired, further longitudinal strap sections can extend between strap section 322 and rear upper hub 320, with such further strap sections engaging one or more lateral strap sections. Such lateral and longitudinal strap sections may form a web for support of bedding 302 and an infant in the bedding 302. When there is no infant in the bedding 302, i.e., when there is no weight on the bedding 302, strap section 362 is relaxed and not taut. When there is an infant in the bedding 302, i.e., when there is downward pressure on the bedding 302, strap section 362 is taut. When frame 306 is folded from the open and operating position to the closed position, strap section 362 becomes even more relaxed because support members 38, 40 are drawn toward each other during this folding.

Strapping 308 includes an independent strap section 364 that is engaged between upper rear hub 320 and lower rear hub 318. This strap section 364 has a first strap portion 366 engaged to the lower rear hub 318 and a second strap portion 368 engaged to the upper rear hub 320. The strap portions 366, 368 are adjustably engaged to each other by respective buckle portions that form a buckle 370 such that strap section 364 is adjustable in length. First, strap section 364, when buckle 370 is engaged, stops a folding from the open and operating configuration to the closed position by stopping a drawing apart of rear upper hub 320 from rear lower hub 318, thereby also stopping a drawing apart of front upper hub 314 from front lower hub 310, and thereby further stopping a drawing apart of front upper hub 316 from front lower hub 312. When the frame 306 is lifted from a surface with buckle 370 engaged, frame 306 does not fold from the open position to the closed position. In other words, strap section 322 prevents the frame 306 from folding or scissoring in one direction, and strap section 364, when buckle 370 is engaged, prevents the frame 306 from folding or scissoring in the other direction. Second, strap section 364 is adjustable in length by adjusting the position of the buckle portion on strap portion 368. Such adjustment provides a custom range of limited folding from the open position of the frame to a position intermediate of the open position and closed position. When the buckle 370 is disengaged, frame 306 may be folded to the closed position.

Strapping 308 is flexible. Each of the strap sections 322, 360, 362 and 364 is flexible. Each of the strap portions 366, 368 is flexible.

Canopy 304 includes a canopy frame 372 and canopy sheeting 374. Canopy frame 372 includes each of the connection bases 358, a pair of canopy hubs 376, and a pair of front and rear resilient plastic strips 378, 380.

Figure 15A:
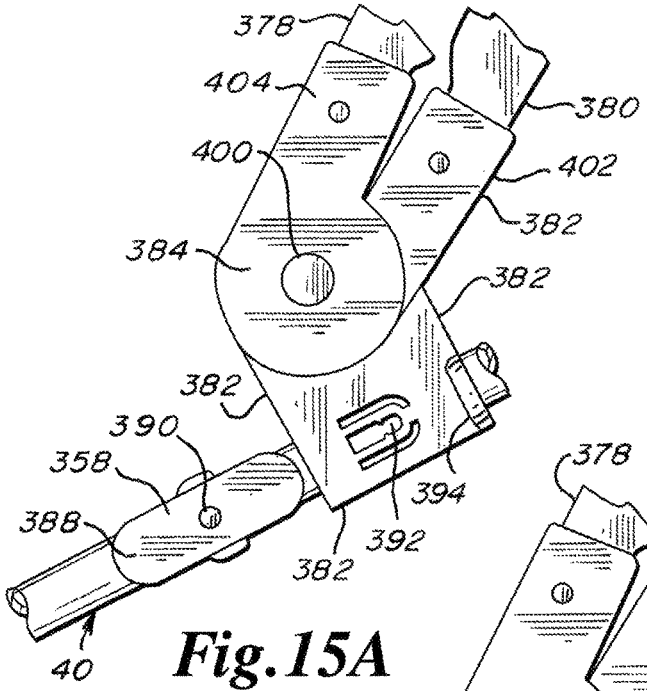
FIG. 15A is a side view of one of the junctions between the frame and the canopy immediately prior to the canopy being engaged to the frame.
Figure 15B:
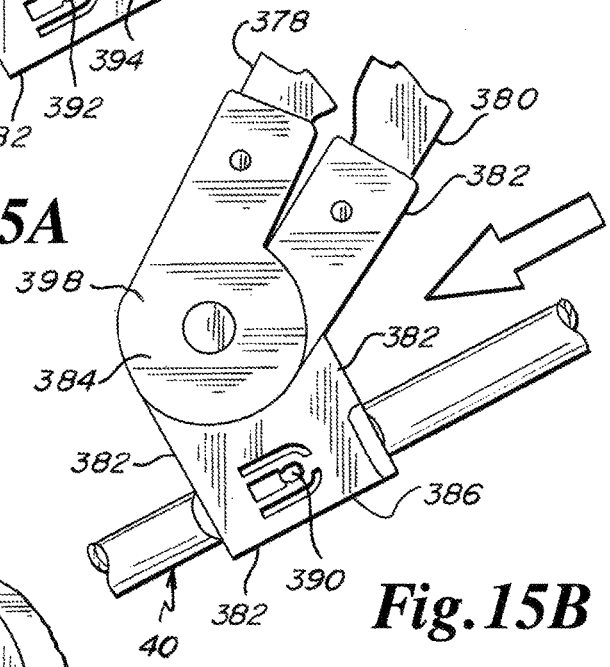
FIG. 15B is a side view of the junction of FIG. 15A between the frame and the canopy when the canopy is engaged to the frame.

As shown in FIGS. 15A and 15B, each of the canopy hubs 376 includes a base hub portion 382 and a rotatable hub portion 384. Base hub portion 382 includes a C-shaped receiver 386 that engages a T-shaped insert 388 on the connection base 358. T-shaped insert 388 includes a nub or detent 390 that snaps past a narrow neck and into a nub receiver 392 formed in the C-shaped receiver 386. Nub 390 is press fit or frictionally fit into and out of nub receiver 392. An integral extension 394 extends laterally about the width of an adult's finger from the C-shaped receiver 386 to make it easy for a caregiver to push and pull the C-shaped receiver 386 onto and off the T-shaped insert 388 to engage and disengage the canopy 304 from the frame 306. Base hub portion 382 further includes a round intermediate hub part 396 that confronts a rounded hub part 398 of rotatable hub portion 384. Pin 400 pivotally engages hub parts 396, 398 together. Base hub portion 382 further includes a receiver 402 for rear plastic strip 380. Rear plastic strip 380 is pinned in receiver 402.

Rotatable hub portion 384 includes rotatable hub part 398 that confronts nonrotatable hub part 396 of base hub portion 382. Rotatable hub portion 384 further includes a receiver 404 for front plastic strip 378. Front plastic strip 378 is pinned in receiver 404.

Rotatable hub portion 384 is rotatable relative to base hub portion 382. Rotatable hub portion 384 includes an extended and locked position where receivers 402, 404 and their respective resilient plastic strips 380, 378 are swung apart and a retracted position where receivers 402, 404 and their respective resilient plastic strips 380, 378 are swung to an adjacent position. Rotatable hub portion 384 and base hub portion 382 include an internal lock and spring mechanism where hand pressure locks the hub portions 382, 394 relative to each other, where hand pressure unlocks the hub portions 382, 384 from each other, and where immediately upon being unlocked the rotatable hub portion 384 is biased by the internal spring to return its receiver 404 to be adjacent to receiver 402.

Rotatable resilient strip 378 is disposed in a U-shaped form between two rotatable hub portions 384. Base resilient strip 380 is disposed in a U-shaped form between two base hub portions 382. Resilient strips 378, 380 spring out to almost a flat form, but still bowed form such that the bow form is a shallow bow, when the canopy 304 is not engaged to the frame 306.

Figure 17:
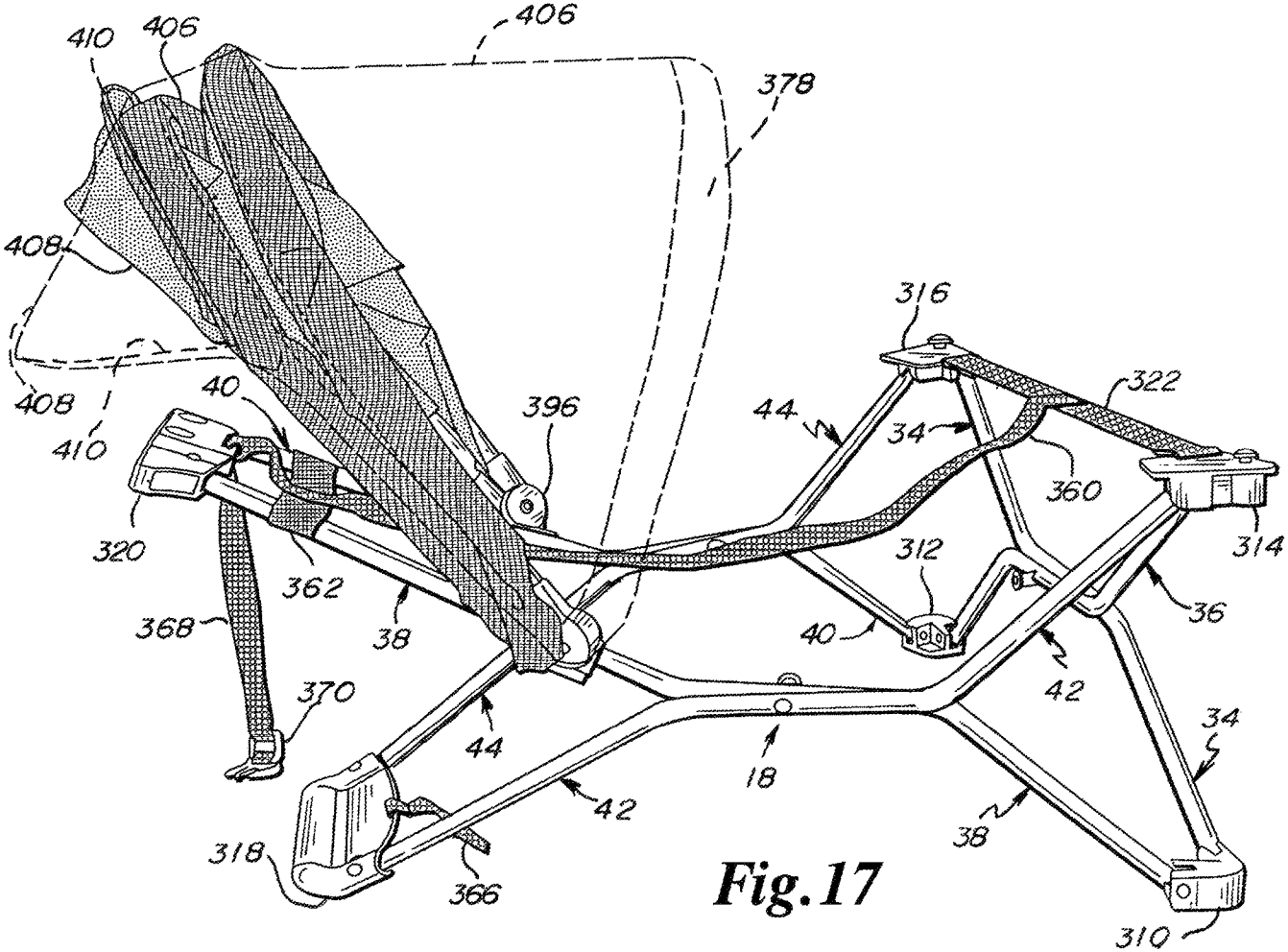
FIG. 17 is a side perspective view of the frame and canopy of the infant lounger of FIG. 13A with the bedding removed.
Figure 18:
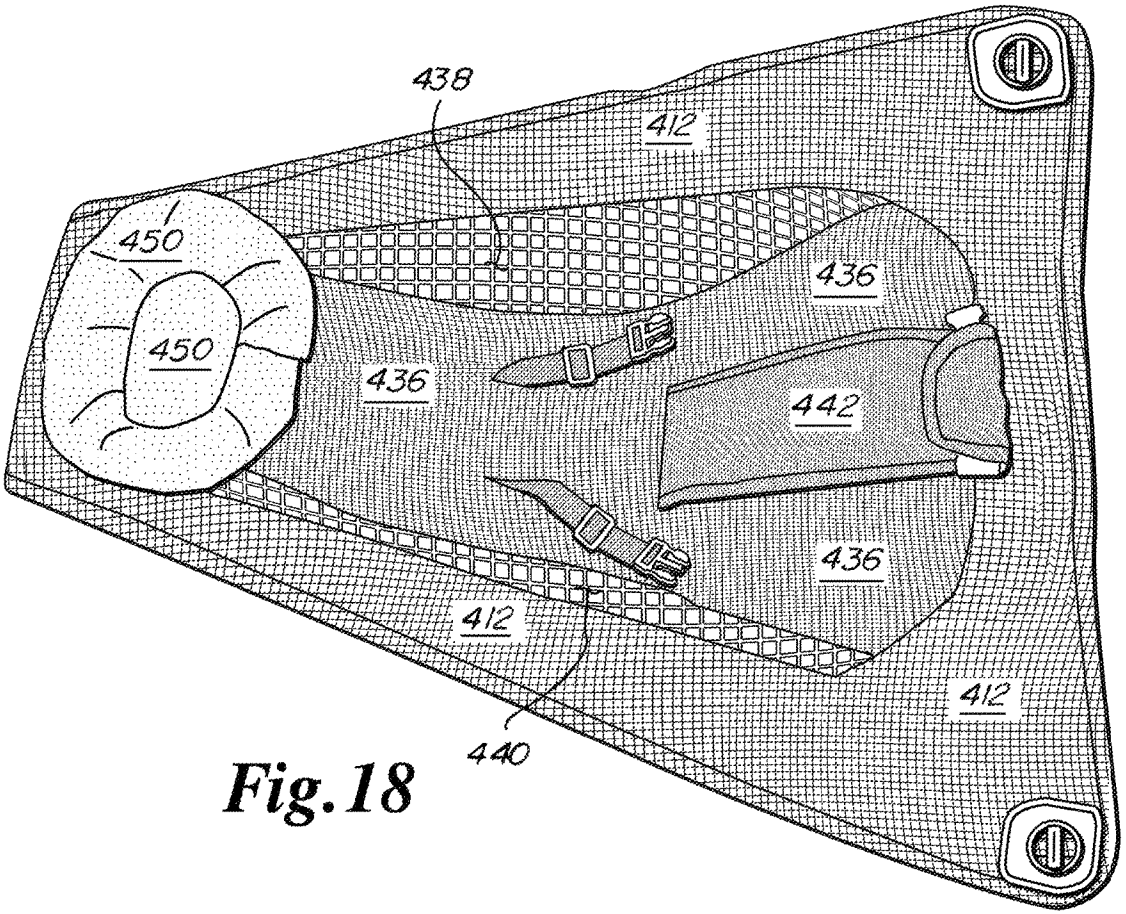
FIG. 18 is a perspective view of the infant lounger of FIG. 13A with the canopy removed and shows a receptacle for the infant.

A first U-shaped canopy portion 406 is engaged to and between resilient plastic strips 378, 380. Strips 378, 380 are received in respective sleeves stitched in opposite ends of canopy portion 406. First U-shaped canopy portion 406 may assume an extended position that is shown by phantom lines in FIG. 17 or a retracted position that is shown by solid lines in FIG. 17. The canopy portion 406 automatically retracts when hub portions 382, 384 are unlocked relative to each other. When viewed from the top, canopy portion 406 is generally diamond shaped or generally elliptical shaped.

A second U-shaped canopy portion 408 is stitched to the rear edge of canopy portion 406 and extends between the rear edge of canopy portion 406 and a U-shaped flexible rod 410 that is received in a sleeve stitched in the rear edge of canopy portion 408. The opposite ends of flexible rod 410 are disposed freely and unengaged inside the sleeve for flexible rod 410. Second U-shaped canopy portion 408 may assume an extended position that is shown by phantom lines in FIG. 17 or a retracted position that is shown by solid lines in FIG. 17. When viewed from the rear, canopy portion 408 is generally diamond shaped or generally elliptical shaped.

Bedding 302 includes a main or base section 412 that is generally triangular in shape. Section 412 may also be described as having four sides, where a first front side or end 414 is relatively long, where second and third opposite oblique sides 416, 418 taper toward each other and away from the first front side 414, and where a fourth side or end 420 is relatively short and runs parallel to the first side 414.

At the junction of sides 414 and 416, main section 412 includes a flexible plastic hub connection 422 that engages pin 334 of upper front hub 316. At the junction of sides 414 and 418, main section 412 includes a flexible plastic hub connection 424 that engages pin 334 of upper front hub 314. Adjacent rear side 420, main section 412 includes a pair of flexible plastic hub connections 426 that are integral and one-piece and that engage pins 334 of the upper rear hub 320.

Figure 13C:
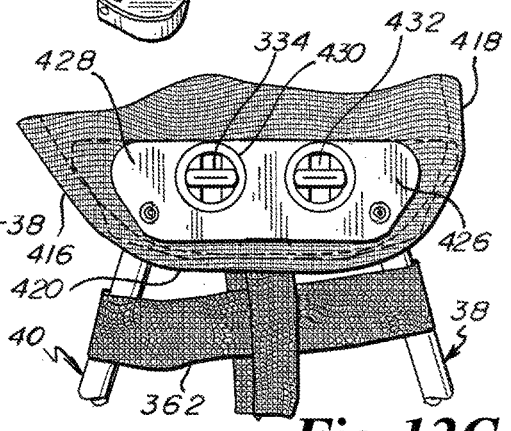
FIG. 13C is a rear view of a rear portion of the frame after a rear portion of the flexible sheeting has been engaged to the frame.
Figure 14:
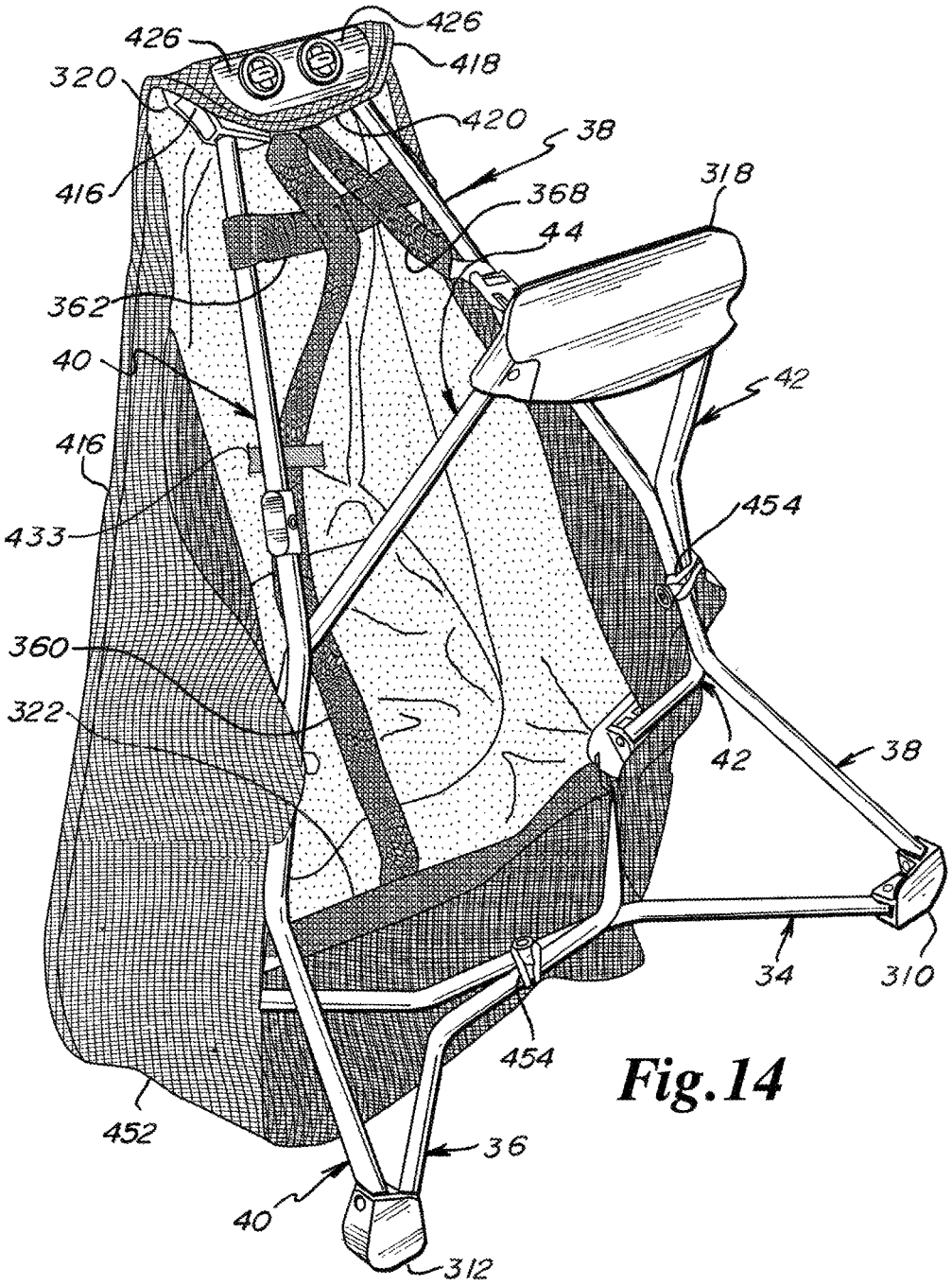
FIG. 14 is a perspective view of the infant lounger lifted up so as to view interior and bottom portions of the flexible sheeting and frame.
Figure 15C:
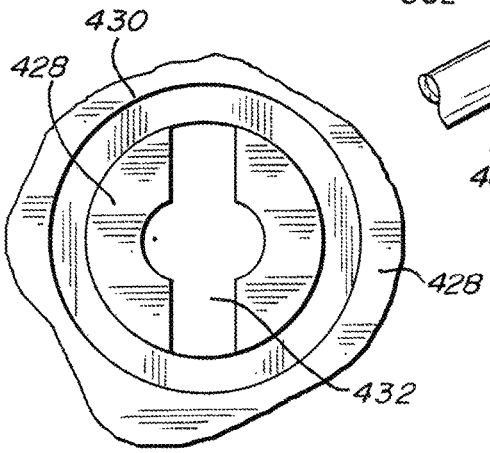
FIG. 15C shows a portion of a flexible plastic connection stitched to the main section of the bedding of the lounger of FIG. 12 to engage the bedding to the frame of the lounger of FIG. 12.
Figure 16A:
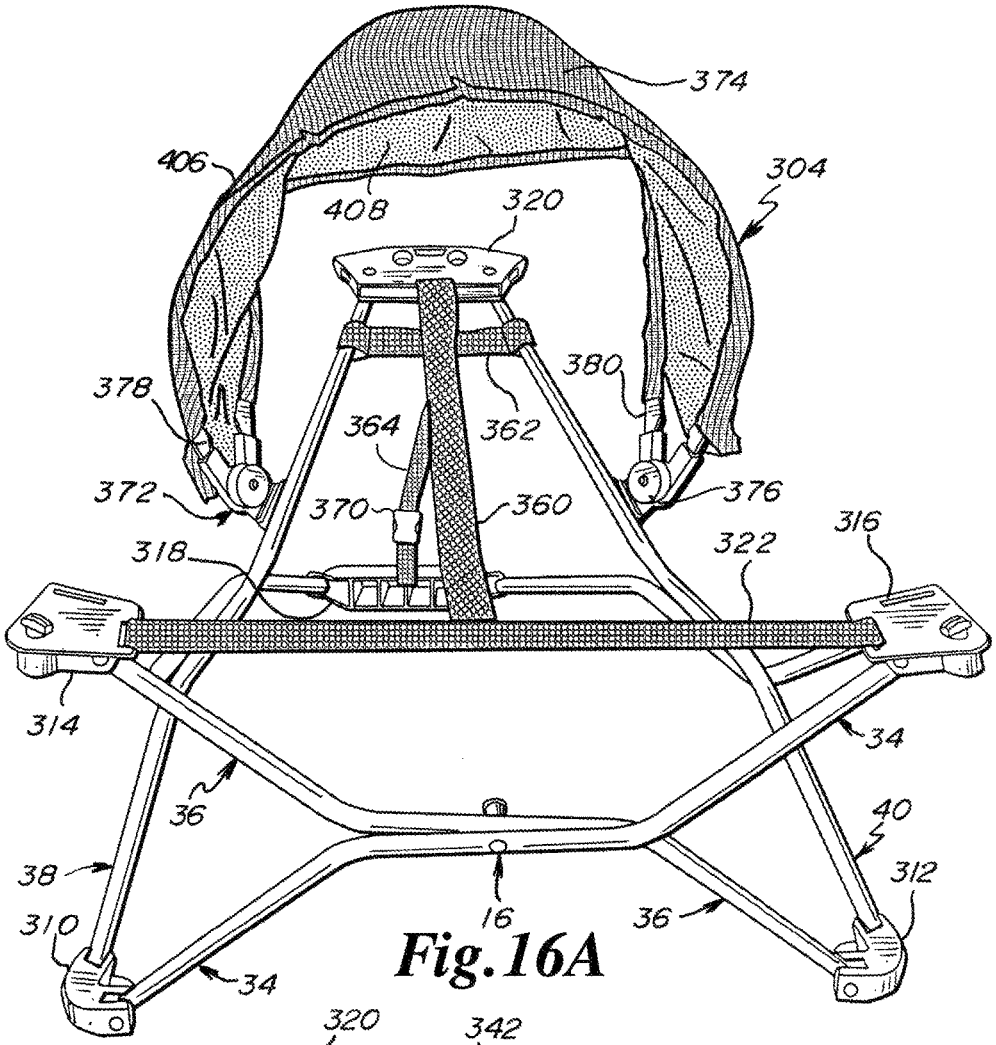
FIG. 16A is a front perspective view of the frame and canopy of the infant lounger of FIG. 13A with the bedding removed.
Figure 16B:
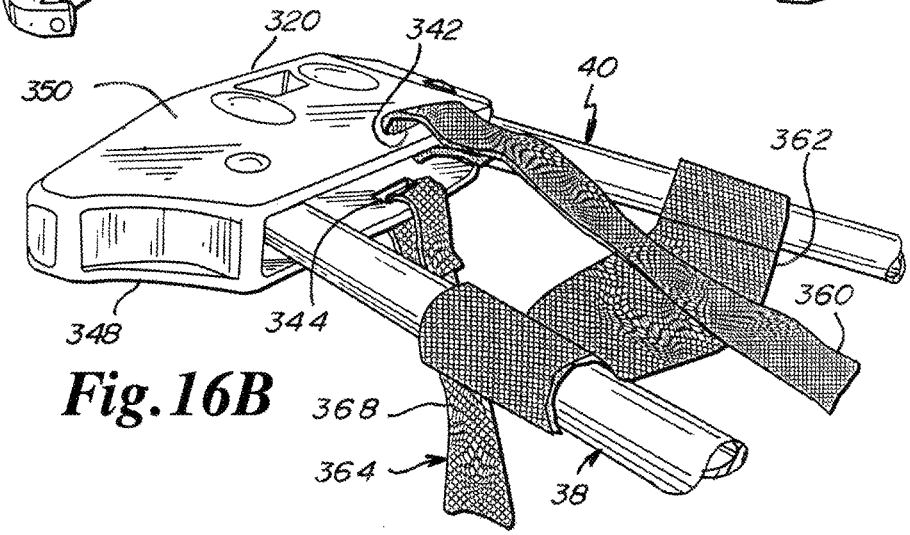
FIG. 16B is a detail view of the upper rear hub of the frame of the infant lounger of FIG. 12 and further shows strapping associated with the upper rear hub.

As shown in FIGS. 13C and 15C, each of the flexible plastic hub connections 422, 424, and 426 includes a flexible plastic base 428, a flexible ring or oval element 430, and a keyhole shaped opening 432 formed in the portion of the base 428 that is within the flexible ring 430. The portion of the base 428 that is within the flexible ring 430 is flexible. The flexible hub connections 422, 424, and 426 may be formed of a flexible nylon such that the flexible plastic base 428 is formed of a flexible nylon, the flexible ring or oval element 430 is formed of nylon, and such that the portion of the base 428 that is within the flexible ring 430 is formed of flexible nylon.

Keyhole shaped opening or slot 432 receives the head of pin 334 and the central rounded half portions receive the shaft of the pin 334. The flexible ring 430 may be slightly oval shaped such that, then the head of the pin 334 is rotated therein to a closed position, the opposite ends of the head of the pin 334 friction fit against the inner surface of flexible ring 430 so as to minimize rotation of the pin head out of the locked position and toward the open position. With an oval ring, less friction resistance is increasingly present when the head of the pin 334 rotates from the locked position to the open position. With an oval ring, greater friction resistance is increasingly present when the head of the pin 334 rotates from the open position to the locked position.

Main section 412 includes a generally triangular peripheral portion 434 that tracks the periphery of the four sides 414, 416, 418, 420 and includes upper and lower flexible sheeting that is nonstretchable. Disposed between the upper and lower sheeting of the peripheral portion 434 is a flexible pillow material that is resilient. Such flexible pillow material may be an open cell foam or a closed cell foam. Each of the sides of the peripheral portion 434 that are adjacent to sides 416 and 418 taper from a greater width to a lesser width as the sides of the peripheral portion extend from a front position to a rear position.

Main section 412 includes a longitudinal portion 436 that runs to and between the inner edges of front and rear ends of the peripheral portion 434. Longitudinal portion 436 includes upper and lower flexible sheeting that is nonstretchable. Disposed between the upper and lower sheeting of longitudinal portion 436 is a flexible pillow material that is resilient. Such flexible pillow material may be an open cell foam or a closed cell foam. A front part of the longitudinal portion 436 provides a seat for an infant. A rear part of the longitudinal portion 436 provides a seat back for the infant. The seat of the longitudinal portion 436 tapers inwardly from a front portion to a rear portion. The seat back of the longitudinal portion 436 tapers from a greater width to a small width as the seat back extends from a front position to a rear position.

Main section 412 includes first and second side pieces 438, 440 of stretchable or elastic or resilient sheeting. Each of the first and second elastic side pieces 438, 440 is generally diamond shaped. Elastic first side piece 438 is engaged between an inner side of the peripheral portion 434 and an outer side of longitudinal portion 436. Elastic second side piece 440 is engaged between an inner side of the peripheral portion 434 and an outer side of longitudinal portion 436. Each of the side pieces 438, 440 is a single layer. Elastic side pieces 438, 440 provide a resilient give when an infant is on the longitudinal portion 436 and further provide a receptacle for the infant since elastic side pieces 438, 440 and longitudinal portion 436 extend below an altitude of the peripheral portion 434.

An interior portion of longitudinal portion 436 includes a longitudinal running infant retaining strip 442 for running between the legs of an infant to the stomach or chest of the infant. The front end of the infant retaining strip 442 is engaged to the longitudinal portion 436 between the seat and the seat back portions of the longitudinal portion 436. The rear end of the infant retaining strip 442 is free and includes a sleeve having therein a strap portion that includes female buckle ends. One of the female buckle ends is engagable to and disengagable from a first strap portion 444 and the other of the female buckle ends is engagable to and disengagable from a second strap portion 446. First strap portion 444 includes a free end having a male buckle engagable to one of the female buckle ends. Second strap portion 446 includes a free end having a male buckle engagable to the other of the female buckle ends. Strap portion 444 and strap portion 446 are one piece and integral with each other so as to form a single strap 443. Strap portion 444 passes through a first set of slots formed in the upper and lower sheeting of longitudinal portion 436, strap 446 passes through a different set of slots 448 formed in longitudinal portion 436, and then the strap portions 444, 446 are joined integrally under the longitudinal portion 436. The strap 443 that is made up of strap portions 444, 446 preferably engages, by extending under, longitudinal strap section 360 of strapping 308 such that an infant is directly secured to a strap portion of the frame 306. In other words, since strap 443 runs under strap section 360, the infant is secured to not only bedding 302 but to frame 306 through strap section 360.

Main section 412 includes a head receptor 450. Head receptor 450 includes a peripheral section that includes front and rear portions that are generally parallel and side opposing portions that are rounded or circular. If desired, head receptor 450 may form a circle or be oval shaped or form an ellipse. Head receptor 450 includes a central portion. Each of the front and rear portions is formed of a pillow or cushioned flexible material that may include an open cell foam or a closed cell foam. The central portion is formed of a pillow or cushioned flexible material that may include open cell foam or closed cell foam. The peripheral portion of the head receptor 450 extends freely of the longitudinal portion 436. Head receptor 450 is engaged, such as by stitching, to the longitudinal portion 436 at the outer edge of the central portion of the head receptor 450.

Bedding 302 further includes a skirt 452. Skirt 452 depends from the oblique sides of main section 412 and further depends from the front side or end of main section 412. Skirt 452 includes three elastic loops 454 that engage pins 352, 354, 356 at respective pivot locations 16, 18, 20 of frame 306. One elastic loop 454 engages the bottom edge of a right side of skirt 452. A second elastic loop 454 engages a left side of skirt 452. A third elastic loop 454 engages the bottom edge of a front side of the skirt 452. Each of the right and left sides of skirt 452 is generally triangular. The front side of skirt 452 is rectangular. Each of the right, left and front sides of skirt 452 is formed a single sheet of flexible, nonelastic sheeting.

In operation, either a) the frame 306 or b) the frame 306 having the bedding 302 engaged thereon or c) the frame 306 having the bedding 302 and canopy 304 engaged thereon may be opened from the folded in and compact position shown with respect to lounger 10 in FIGS. 8A, 8B and 11 to an open and operation position where, for example, the frame 302 is shown in FIG. 12 and where, for example, the frame 306, bedding 302, and canopy 304 are shown in FIG.

13A. Such an opening is accomplished by first taking hold of first upper front hub 314 with one hand and second upper front hub 316 with the other hand. Then the hubs 314, 316 are drawn apart, an action that will simultaneously a) draw apart the first lower front hub 310 and second lower front hub 312 by a scissoring of support members 34 and 36, b) draw apart the second lower front hub 312 and rear lower hub 318 by a scissoring of support members 40, 44, c) draw apart the first lower front hub 310 and rear lower hub 318 by a scissoring of support members 38 and 42, d) draw apart the first upper front hub 314 and upper rear hub 320 by a scissoring of support members 38 and 42, and e) draw apart the second upper front hub 316 and the upper rear hub 320 by a scissoring of support members 40, 44.

If just the frame 306 is being opened, then the next step is to place the bedding 302 on the frame 306. Here connectors 422, 424 and 426 are engaged with their respective pins 334. Pins 334 are fed through the respective keyhole slots 432 and then rotated for 90 degrees such that the pin 334 cannot exit through the keyhole slot 432 without being rotated back. Then the elastic loops 454 of the skirt 452 are wrapped under respective pairs of support members 34, 36 and 38, 42 and 40, 44 at respective pivot locations 16, 18, 20 and engaged to pins 352. Then the canopy 304 is engaged to the frame 306 at the connection bases 358.

The infant lounger 300 may then be placed on a surface, such as the carpeted floor of a living room. The lateral strap sections 322 and 362 then work as stops to prevent folding in one direction beyond a predefined position. Then the strap sections 366, 368 may be engaged to each other by buckle 370 so as to prevent an undesired folding of the frame 306 in the other direction back to the closed position or folded in and compact position. Strap sections 366, 368 may be adjusted such that, in the open and operating position, the rear lower hub 381 and the upper rear hub 320 cannot be drawn apart, whereby strap section 322 prevents folding of the frame 306 in one direction and whereby strap sections 366, 368 when buckled together prevent folding of the frame 306 in the other direction such that scissoring of the frame 306 is minimized in either direction.

Then an infant may be placed in the bedding 302, within the peripheral portion 434, and generally on the longitudinal portion 436, with the head of the infant resting in the head rest 450, and with the support piece 442 extending between the legs of the infant and up to the stomach or chest of the infant. Then the male ends of the strap sections 444, 446 are engaged to the female ends of the strap section engaged in the sleeve of the distal end of the support piece 442. As the infant is laid in the bedding 302, the infant is cradled by one or more of the longitudinal portion 436, elastic portions 438, 440, the pillow 450, the peripheral portion 434, and strap section 360. Elastic portions 438, 440 resiliently give as the infant is laid therein. The frame 306 as a whole resiliently gives through strap sections 322 and 362 and then to strap section 360 that supports the bedding of the infant. Then, since the frame 306 of the lounger 300 does not scissor in either direction, the lounger 300 as a whole may be picked up with the infant cradled in the bedding 302.

If the canopy 304 is being utilized, the canopy 304 may be used in a fully open position where both front canopy portion 406 and rear canopy portion 408 are extended, where front canopy portion 406 is extended and rear canopy portion 408 is retracted, where rear canopy portion 408 is extended and front canopy portion 406 is retracted, or where both the front and rear canopy portions 406, 408 are retracted.

When the infant is to be removed from the lounger 300, the male buckle ends of strap sections 444, 446 are disengaged from the female buckle ends of the strap section housed in the sleeve at the distal end of section 442 and then the infant is lifted out of the bedding 302. Then, the lounger 300 may be collapsed to a closed or folded in form by unbuckling buckle 370 and drawing upper rear hub 320 and lower rear hub 318 away from each other. The lounger 300 may also be collapsed by, after the buckle 370 is unbuckled, drawing front lower hub 310 away from front upper hub 314. The lounger 300 may also be collapsed by, after buckle 370 is unbuckled, drawing front lower hub 312 away from front upper hub 316.

Before collapsing the lounger 300 it may be desired to take off one or more of the canopy 304 and bedding 302. The canopy 304 is removed by sliding the C-receiver 386 off of the T-shaped insert 388 of the connection base 358, where the caretaker pulls up the extension 394 with his or her first finger curled up about the extension 394.

Before collapsing the lounger 300 it may be desired to remove the bedding 302. Bedding 302 is removed from frame 306 by disengaging elastic loops 454 of the skirt 452 from pins 352, 354 and 356, then turning the heads of pins 334 so as to align the head of the pin 334 with the keyhole slot 432, and then working the head of the pin 334 through the keyhole slot 432 and through the fabric of the bedding 302.

The first support member 34 terminates at the first lower hub 22 and further terminates at the second upper front hub 28. The second support member 36 terminates at the second lower front hub 24 and further terminates at the first upper front hub 26. The third support member 38 terminates at the first lower front hub 22 and further terminates at the upper rear hub 32. The fourth support member 40 terminates at the second lower front hub 24 and further terminates at the upper rear hub 32. The fifth support member 42 terminates at the first upper front hub 26 and further terminates at the lower rear hub 30. The sixth support member 44 terminates at the second upper front hub 28 and further terminates at the lower rear hub 30.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A three pivot point foldable frame, comprising:

a) first and second lower front hubs;

b) first and second upper front hubs;

c) a lower rear hub;

d) an upper rear hub;

e) a first support member extending between the first lower front hub and the second upper front hub, the first support member terminating at the first lower hub and further terminating at the second upper front hub, the first support member being integral and one-piece, the first support member having a first middle section, a first lower section, and a first upper section, each of the first middle, lower and upper sections being straight, the first lower and upper sections being oblique relative to the first middle section;

f) a second support member extending between the second lower front hub and first upper front hub, the second support member terminating at the second lower front hub and further terminating at the first upper front hub, the second support member being integral and one-piece, the second support member having a second middle section, a second lower section, and a second upper section, each of the second middle, lower and upper sections being straight, the second lower and upper sections being oblique relative to the second middle section;

g) a third support member extending between the first lower front hub and the upper rear hub, the third support member terminating at the first lower front hub and further terminating at the upper rear hub, the third support member being integral and one-piece, the third support member having a third middle section, a third lower section, and a third upper section, each of the third middle, lower and upper sections being straight, the third lower and upper sections being oblique relative to the third middle section;

h) a fourth support member extending between the second lower front hub and the upper rear hub, the fourth support member terminating at the second lower front hub and further terminating at the upper rear hub, the fourth support member being integral and one-piece, the fourth support member having a fourth middle section, a fourth lower section, and a fourth upper section, each of the fourth middle, lower and upper sections being straight, the fourth lower and upper sections being oblique relative to the fourth middle section;

i) a fifth support member extending between the first upper front hub and the lower rear hub, the fifth support member terminating at the first upper front hub and further terminating at the lower rear hub, the fifth support member being integral and one-piece, the fifth support member having a fifth middle section, a fifth lower section, and a fifth upper section, each of the fifth middle, lower and upper sections being straight, the fifth lower and upper sections being oblique relative to the fifth middle section;

j) a sixth support member extending between the second upper front hub and the lower rear hub, the sixth support member terminating at the second upper front hub and further terminating at the lower rear hub, the sixth support member being integral and one-piece, the sixth support member having a sixth middle section, a sixth lower section, and a sixth upper section, each of the sixth middle, lower and upper sections being straight, the sixth lower and upper sections being oblique relative to the sixth middle section;

k) the first and second support members pivotally engaged to each other at a first pivot;

l) the third and fifth support members pivotally engaged to each other at a second pivot;

m) the fourth and sixth support members pivotally engaged to each other at a third pivot; and n) wherein said support members and said hubs provide an endless train, said endless train running from said first lower front hub to said first support member to said second upper front hub to said sixth support member to said lower rear hub to said fifth support member to said first upper front hub to said second support member to said second lower front hub to said fourth support member to said upper rear hub to said third support member and back to said first lower front hub.

2. The three pivot point foldable frame of claim 1, wherein the three pivot point foldable frame includes a folded out and operating position and a folded in and compact position, wherein, in the folded in and compact position, the first and second lower front hubs are adjacent to each other, the first and second upper front hubs are adjacent to each other, and the lower rear hub is adjacent to the first and second lower front hubs.

3. The three pivot point foldable frame of claim 1, wherein the three pivot point foldable frame includes a folded out and operating position and a folded in and compact position, wherein, in the folded out and operating position, the first lower front hub is closer to the first upper front hub than the second lower front hub, and the second lower front hub is closer to the second upper front hub than the first lower front hub.

4. The three pivot point foldable frame of claim 1, wherein each of the first, second, third, fourth, fifth, and sixth support members generally forms the shape of an "S."

5. The three pivot point foldable frame of claim 1, wherein, in a folded out and operating position, the first and second support members, in combination, form generally the shape of an upper case "H."

6. The three pivot point foldable frame of claim 1, wherein each of the first, second, third, fourth, fifth, and sixth support members further comprises first and second transition sections, each of the first and second transition sections being curved, the first transition section being disposed between the lower section and the middle section of each said respective support member, the second transition section being disposed between the upper section and the middle section of each said respective support member.

7. The three pivot point foldable frame of claim 1, wherein the third upper section of the third support member has a greater length than the third lower section of the third support member, and wherein the fourth upper section of the fourth support member has a greater length than the fourth lower section of the fourth support member.

8. The three pivot point foldable frame of claim 1, wherein the fifth lower section of the fifth support member has a greater length than the fifth upper section of the fifth support member, and wherein the sixth lower section of the sixth support member has a greater length than the sixth upper section of the sixth support member.

9. The three pivot point foldable frame of claim 1, wherein the third and fourth upper sections of the third and fourth support members converge toward each other as the third and fourth upper sections of the third and fourth support members extend toward the upper rear hub.

10. The three pivot point foldable frame of claim 1, wherein the fifth and sixth lower sections of the fifth and sixth support members converge toward each other as the fifth and sixth lower sections of the fifth and sixth support members extend toward the lower rear hub.

11. The three pivot point foldable frame of claim 1, wherein the third and fourth lower sections of the third and fourth support members diverge away from each other as said third and fourth lower sections extend toward the first and second lower front hubs, respectively.

12. The three pivot point foldable frame of claim 1, wherein the fifth and sixth upper sections of the fifth and sixth support members diverge away from each other as said fifth and sixth upper sections extend toward the first and second upper front hubs, respectively.

13. The three pivot point foldable frame of claim 1, wherein the third and fourth support members include upper ends, wherein the upper end of the third support member is spaced apart from the upper end of the fourth support member by a first distance, wherein the fifth and sixth support members include lower ends, wherein the lower end of the fifth support member is spaced apart from the lower end of the sixth support member by a second distance, and wherein the second distance is greater than the first distance.

14. The three pivot point foldable frame of claim 1, wherein, in a folded in and compact position, the lower rear hub is disposed at a base elevation, the first and second lower front hubs are disposed at a second elevation greater than the base elevation, the first and second upper front hubs are disposed at a third elevation greater than the second elevation, and the rear hub is disposed at a fourth elevation greater than the third elevation.

15. The three pivot point foldable frame of claim 1, wherein a pivotal engagement at the first lower front hub between said first lower front hub and said first support member defines a first pivot axis, wherein a pivotal engagement at the first lower front hub between said first hub and said third support member defines a second pivot axis, and wherein said first and second pivot axis define an oblique angle.

16. The three pivot point foldable frame of claim 1, and further comprising bedding, the bedding engaged to the first and second upper front hubs and the upper rear hub, the bedding comprising a flexible material, the bedding including a receptacle for an infant.

17. The three pivot point foldable frame of claim 1, and further comprising: a) a first strap engaged between the first and second upper front hubs to minimize a folding of the three pivot point foldable frame in a first direction; and b) a second strap engaged between the upper and lower rear hubs to minimize a folding of the three pivot point foldable frame in a second direction opposite of the first direction such that scissoring of the three pivot point foldable frame is minimized.

18. A three pivot point foldable frame, comprising:

a) first and second lower front hubs;

b) first and second upper front hubs;

c) a lower rear hub;

d) an upper rear hub;

e) a first support member extending between the first lower front hub and the second upper front hub, the first support member terminating at the first lower hub and further terminating at the second upper front hub, the first support member being integral and one-piece, the first support member having a first middle section, a first lower section, and a first upper section, each of the first middle, lower and upper sections being straight, the first lower and upper sections being oblique relative to the first middle section;

f) a second support member extending between the second lower front hub and first upper front hub, the second support member terminating at the second lower front hub and further terminating at the first upper front hub, the second support member being integral and one-piece, the second support member having a second middle section, a second lower section, and a second upper section, each of the second middle, lower and upper sections being straight, the second lower and upper sections being oblique relative to the second middle section;

g) a third support member extending between the first lower front hub and the upper rear hub;

h) a fourth support member extending between the second lower front hub and the upper rear hub;

i) a fifth support member extending between the first upper front hub and the lower rear hub;

j) a sixth support member extending between the second upper front hub and the lower rear hub;

k) the first and second support members pivotally engaged to each other at a first pivot;

l) the third and fifth support members pivotally engaged to each other at a second pivot;

m) the fourth and sixth support members pivotally engaged to each other at a third pivot; and n) wherein said support members and said hubs provide an endless train, said endless train running from said first lower front hub to said first support member to said second upper front hub to said sixth support member to said lower rear hub to said fifth support member to said first upper front hub to said second support member to said second lower front hub to said fourth support member to said upper rear hub to said third support member and back to said first lower front hub.

19. A three pivot point foldable frame, comprising:

a) first and second lower front hubs;

b) first and second upper front hubs;

c) a lower rear hub;

d) an upper rear hub;

e) a first support member extending between the first lower front hub and the second upper front hub;

f) a second support member extending between the second lower front hub and first upper front hub;

g) a third support member extending between the first lower front hub and the upper rear hub, the third support member terminating at the first lower front hub and further terminating at the upper rear hub, the third support member being integral and one-piece, the third support member having a third middle section, a third lower section, and a third upper section, each of the third middle, lower and upper sections being straight, the third lower and upper sections being oblique relative to the third middle section;

h) a fourth support member extending between the second lower front hub and the upper rear hub, the fourth support member terminating at the second lower front hub and further terminating at the upper rear hub, the fourth support member being integral and one-piece, the fourth support member having a fourth middle section, a fourth lower section, and a fourth upper section, each of the fourth middle, lower and upper sections being straight, the fourth lower and upper sections being oblique relative to the fourth middle section;

i) a fifth support member extending between the first upper front hub and the lower rear hub;

j) a sixth support member extending between the second upper front hub and the lower rear hub;

k) the first and second support members pivotally engaged to each other at a first pivot;

l) the third and fifth support members pivotally engaged to each other at a second pivot;

m) the fourth and sixth support members pivotally engaged to each other at a third pivot; and n) wherein said support members and said hubs provide an endless train, said endless train running from said first lower front hub to said first support member to said second upper front hub to said sixth support member to said lower rear hub to said fifth support member to said first upper front hub to said second support member to said second lower front hub to said fourth support member to said upper rear hub to said third support member and back to said first lower front hub.

20. A three pivot point foldable frame, comprising:

a) first and second lower front hubs;

b) first and second upper front hubs;

c) a lower rear hub;

d) an upper rear hub;

e) a first support member extending between the first lower front hub and the second upper front hub;

f) a second support member extending between the second lower front hub and first upper front hub;

g) a third support member extending between the first lower front hub and the upper rear hub;

h) a fourth support member extending between the second lower front hub and the upper rear hub;

i) a fifth support member extending between the first upper front hub and the lower rear hub, the fifth support member terminating at the first upper front hub and further terminating at the lower rear hub, the fifth support member being integral and one-piece, the fifth support member having a fifth middle section, a fifth lower section, and a fifth upper section, each of the fifth middle, lower and upper sections being straight, the fifth lower and upper sections being oblique relative to the fifth middle section;

j) a sixth support member extending between the second upper front hub and the lower rear hub, the sixth support member terminating at the second upper front hub and further terminating at the lower rear hub, the sixth support member being integral and one-piece, the sixth support member having a sixth middle section, a sixth lower section, and a sixth upper section, each of the sixth middle, lower and upper sections being straight, the sixth lower and upper sections being oblique relative to the sixth middle section;

k) the first and second support members pivotally engaged to each other at a first pivot;

l) the third and fifth support members pivotally engaged to each other at a second pivot;

m) the fourth and sixth support members pivotally engaged to each other at a third pivot; and n) wherein said support members and said hubs provide an endless train, said endless train running from said first lower front hub to said first support member to said second upper front hub to said sixth support member to said lower rear hub to said fifth support member to said first upper front hub to said second support member to said second lower front hub to said fourth support member to said upper rear hub to said third support member and back to said first lower front hub.

* * * * *